US007962084B2

(12) United States Patent
Tanaka et al.

(10) Patent No.: US 7,962,084 B2
(45) Date of Patent: Jun. 14, 2011

(54) FIXING DEVICE AND IMAGE FORMING APPARATUS

(75) Inventors: Yasuki Tanaka, Saitama (JP); Yukihiro Ichiki, Saitama (JP); Satoshi Isahai, Saitama (JP); Masami Ishida, Saitama (JP); Masahiro Ishino, Saitama (JP); Hitoshi Nanba, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 12/630,243

(22) Filed: Dec. 3, 2009

(65) Prior Publication Data

US 2010/0247186 A1 Sep. 30, 2010

(30) Foreign Application Priority Data

Mar. 27, 2009 (JP) ..... P2009-078844

(51) Int. Cl.
*G03G 15/20* (2006.01)

(52) U.S. Cl. ..... 399/329; 399/330

(58) Field of Classification Search ..... 399/328–330
See application file for complete search history.

(56) References Cited

U.S. PATENT DOCUMENTS

| | | | | |
|---|---|---|---|---|
| 5,621,512 | A | 4/1997 | Uehara et al. | 399/328 |
| 5,809,389 | A * | 9/1998 | Tamura et al. | 399/322 |
| 7,664,452 | B2 * | 2/2010 | Nakajima | 399/329 |
| 2008/0175613 | A1 | 7/2008 | Fukai et al. | 399/67 |

FOREIGN PATENT DOCUMENTS

| | | |
|---|---|---|
| JP | 8-262903 | 10/1996 |
| JP | 11-045025 | 2/1999 |
| JP | 2004-205620 | 7/2004 |
| JP | 2005-004126 | 1/2005 |
| JP | 2006-017867 | 1/2006 |
| JP | 2006-276104 | 10/2006 |
| JP | 2007-057784 | 3/2007 |
| JP | 2008-102484 | 5/2008 |
| JP | 2008-233133 | 10/2008 |

* cited by examiner

*Primary Examiner* — Hoang Ngo

(74) *Attorney, Agent, or Firm* — Morgan, Lewis & Bockius LLP

(57) ABSTRACT

A fixing device comprises a heating roll; an endless belt; and a pressurizing member that forms a pressure contact portion for pushing the endless belt against an outer peripheral surface part of the heating roll from an inner peripheral surface side of the pressurizing member so that a recording medium holding an unfixed image passes between the pressure contact portion and the heating roll, wherein the pressurizing member includes: a hard pressurizing member and a soft pressurizing member the hard pressurizing member, and the soft pressurizing member are disposed in a state in which a clearance is present between the hard pressurizing member and the soft pressurizing member in a specific region part so that at least a specific recording medium passes in a fixing region of the pressure contact portion in the rotating axis direction of the heating roll.

8 Claims, 19 Drawing Sheets

FIG. 13

| CLEARANCE BETWEEN PAD AND Head | PAD PROTRUDING AMOUNT | Nip WIDTH | ENVELOPE CREASE | | | | |
|---|---|---|---|---|---|---|---|
| | | | CO125 | | CO131 | | AVERAGE |
| | | | SURFACE | BACK | SURFACE | BACK | |
| 0mm | 0. 5 | 4.5 | 0 | 0 | 2 | 0 | 0.5 |
| | 0. 7 | 5.3 | 1 | 2 | 2 | 2 | 1.75 |
| | 0. 8 | 6.0 | 1 | 2 | 1 | 3 | 1.75 |
| | 1. 0 | 6.4 | 1 | 2 | 2 | 3 | 2 |
| 1mm | 0. 7 | 5.2 | 0 | 0 | 1 | 1 | 0.5 |
| | 1. 0 | 5.6 | 1 | 0 | 1 | 2 | 1 |
| | 1. 2 | 6.2 | 1 | 1 | 1 | 2 | 1.25 |
| 2mm | 0. 7 | 5.3 | 0 | 0 | 1 | 0 | 0.25 |
| | 1. 0 | 5.7 | 0 | 0 | 1 | 0. 5 | 0.375 |
| | 1. 2 | 5.9 | 0 | 0 | 1 | 1 | 0.5 |
| 3mm | 0. 5 | 2.8 | 1 | 0 | 1 | 1 | 0.75 |
| | 0. 7 | 5.1 | 0 | 0 | 1 | 0 | 0.25 |
| | 1. 0 | 5.9 | 0 | 0 | 1 | 0 | 0.25 |
| | 1. 2 | 6.1 | 0 | 0 | 1 | 1 | 0.5 |

FIXING DEVICE AND IMAGE FORMING APPARATUS

CROSS-REFERENCE TO RELATED APPLICATION

This application is based on and claims priority under 35 USC 119 from Japanese Patent Application No. 2009-078844 filed on May 27, 2009.

BACKGROUND

1. Technical Field

The present invention relates to a fixing device and an image forming apparatus.

2. Related Art

In an image forming apparatus such as a printer, a copying machine or a facsimile, an unfixed image formed by a development through a developer is transferred onto a recording medium such as a paper, and the unfixed image thus transferred is heated and pressurized and is fixed onto the recording medium by a fixing device so that an image such as a character, a graphic, a pattern or a photograph image is formed.

The fixing device to be used in the image forming apparatus includes a belt fixing device having the following structure. The belt fixing device includes a heating rotor having a roll configuration to be heated by heating unit and to be thus rotated, an endless belt to be rotated in contact with an outer peripheral surface part in a direction of a rotating axis of the heating rotor, and a pressurizing member forming a pressure contact portion for pushing the endless belt against the outer peripheral surface part of the heating rotor to cause a recording medium having an unfixed image held thereon to pass between the pressure contact portion and the heating rotor.

In the belt fixing device of this type, the recording medium having the unfixed image held thereon is introduced into the pressure contact portion formed between the heating rotor and the endless belt and is caused to pass, and the unfixed image is thus heated and pressurized and is fixed onto the recording medium.

SUMMARY

According to an aspect of the invention, a fixing device comprises: a heating roll that includes an outer peripheral surface having an elastic layer formed thereon and is heated by a heating unit and is rotated; an endless belt to be rotated in contact with an outer peripheral surface part in a rotating axis direction of the heating roll; and a pressurizing member that forms a pressure contact portion for pushing the endless belt against the outer peripheral surface part of the heating roll from an inner peripheral surface side of the pressurizing member so that a recording medium holding an unfixed image passes between the pressure contact portion and the heating roll, wherein the pressurizing member includes: a hard pressurizing member disposed in a position on a downstream side in a passing direction of the recording medium in the pressure contact portion and having a higher hardness than that of the elastic layer of the heating roll; and a soft pressurizing member disposed in a position on an upstream side in the passing direction from the hard pressurizing member and having a lower hardness than that of the elastic layer of the heating roll to carry out an elastic deformation, and the hard pressurizing member and the soft pressurizing member are disposed in a state in which a clearance is present between the hard pressurizing member and the soft pressurizing member in a specific region part so that at least a specific recording medium passes in a fixing region of the pressure contact portion in the rotating axis direction of the heating roll.

BRIEF DESCRIPTION OF THE DRAWINGS

Embodiments of the invention will be described in detail based on the following figures, wherein:

FIG. 13 is a table showing a result of an evaluation test;

DETAILED DESCRIPTION

A configuration for carrying out the invention (which will be hereinafter referred to as an "embodiment") will be described below with reference to the drawings.

Figure 1:
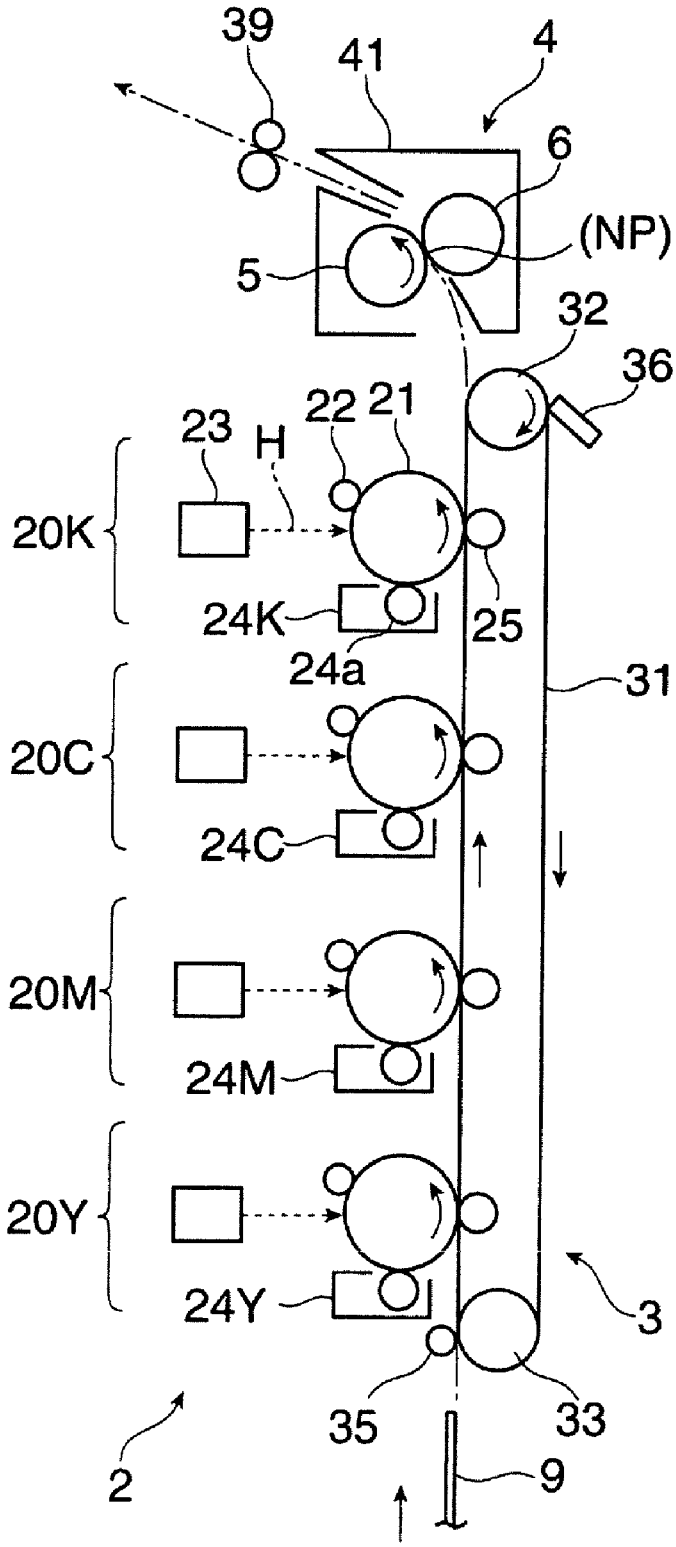
FIG. 1 is an explanatory view showing an outline of a fixing device and an image forming apparatus according to an embodiment.

An image forming apparatus 1 is constituted as a color printer for forming a multicolor image and a monochrome (black-and-white) image, for example. As shown in FIG. 1, an imaging device 2, a paper transport device 3 and a fixing device 4 are mainly provided in an internal space of a housing which is not shown. The imaging device 2 serves to form a toner image to be developed with a toner (colored fine powder) to be a dry developer based on input image data and to finally transfer the toner image onto a recording medium 9 such as a paper. The paper transport device 3 serves to transport the recording medium 9 to pass through a transfer position of each imaging device 2. The fixing device 4 serves to cause the recording medium 9 having the toner image transferred thereto to pass, thereby fixing the toner image. A one-dotted chain line having an arrow in the drawing indicates a main transporting path of the recording medium 9.

The imaging device 2 is constituted by four imaging devices 20Y, 20M, 20C and 20K for exclusively forming toner images having four colors of yellow (Y), magenta (M), cyan (C) and black (K) by utilizing a recording method such as a well-known electrophotographic method. Moreover, the four imaging devices 20 (Y, M, C, K) are arranged in series in a vertical direction, for example.

Each of the imaging devices (20Y, 20M, 20C, 20K) basically includes a photosensitive drum 21 to be rotated and driven in a direction shown in an arrow (a counterclockwise direction in the drawing) and has a structure in which the following devices are mainly disposed around the photosensitive drum 21. The main devices includes a charging device 22 for charging a surface (an image holding surface) of the photosensitive drum 21 into a predetermined potential, an exposing device 23 for irradiating a light H based on the four-color components subjected to a color separation of image data (a signal) onto the surface of the charged photosensitive drum 21, thereby forming an electrostatic latent image (having each color component) with a potential difference, a developing device 24 (Y, M, C, K) for developing the electrostatic latent image having each color component with a toner having a corresponding color (Y, M, C, K), thereby forming a toner image, and a transferring device 25 having a transferring roll for transferring the toner image onto the recording medium 9 transported by means of (a paper transport belt 31) of the paper transport device 3.

For example, the photosensitive drum 21 is obtained by forming the image holding surface having a photosensitive layer (a photoconductive layer) constituted by an organic photosensitive material on a peripheral surface of a cylindrical substrate which is grounded. For the charging device 22, there is used a contact charging method of applying a charging voltage to a charging roll to be rotated in contact with the surface of the photosensitive drum 21, thereby carrying out charging. The exposing device 23 to be used is constituted by an LED (a light emitting diode) type recording head and a semiconductor laser scanning device. An image signal is input to the exposing device 23. The image signal is obtained by carrying out a predetermined processing, through an image processing device (not shown), over image information input from an external apparatus serving as an image creating source, for example, an image reading device, a storing medium reading device or a computer which is provided in or connected to (including a radio communication) to the image forming apparatus 1.

For the developing device 24 to be used, a developer (a single component developer or a two-component developer) containing a toner having a predetermined color is supplied in a charging state to the surface of the photosensitive drum 21 through a developing roll 24*a* to which a developing voltage is applied. For the transferring device 25, there is used a contact type for applying a transferring voltage to the transferring roll to be rotated in contact with the surface of the photosensitive drum 21, thereby carrying out a transferring operation.

The paper transport device 3 is mainly constituted by the paper transport belt 31, a plurality of supporting rolls 32 and 33, an adsorbing roll 35, and a belt cleaning device 36. The paper transport belt 31 is rotated in a direction shown in an arrow (a counterclockwise direction in the drawing) while passing through a portion (a transferring position) between the photosensitive drum 21 of the imaging device 2 (20) and the transferring device 25. The supporting rolls 32 and 33 rotatably support the paper transport belt 31 which is wrapped in a desired condition.

The adsorbing roll 35 serves to electrostatically adsorb the papers 9 supplied one by one from a paper feeding device (not shown) onto an outer peripheral surface of the paper transport belt 31. The belt cleaning device 36 serves to remove a stuck substance such as an unnecessary toner or paper powder stuck to the outer peripheral surface of the paper transport belt 31. For the paper transport belt 31 to be used, a material having a resistance regulating agent such as carbon dispersed in a predetermined amount into a synthetic resin such as a polyimide resin or a polyamide resin is utilized to be molded into a belt configuration taking an endless shape in a predetermined thickness. The supporting roll 32 is constituted as a driving roll and is rotated by a rotating power transmitted from a rotating and driving device including a motor which is not shown. A paper adsorbing voltage is applied from a power device (not shown) to the adsorbing roll 35 at a time that the paper 9 is adsorbed.

The fixing device 4 has a heating rotor 5 and a pressurizing rotor 6 provided in a housing 41. The heating rotor 5 takes a roll configuration in which it is heated to hold a surface temperature into a predetermined temperature by heating unit and is rotated in a direction shown in an arrow. The pressurizing rotor 6 takes a belt configuration in which it is rotated while forming a pressure contact portion (a fixation processing portion) NP to come in contact with a surface part almost in a direction of a rotating axis of the heating rotor 5 at a predetermined pressure. The reference numeral 39 in FIG. 1 denotes a discharging roll pair for discharging the recording medium 9 subjected to the fixation from the fixing device 4. The details of the fixing device 4 will be described below.

The paper feeding device is mainly constituted by at least one housing cassette and a transmitting device. The housing cassette accommodates a plurality of recording media 9 having a predetermined size and type which is to be supplied to the imaging device 2 (20) in a stacking state. The transmitting device transmits and transports the recording media 9 accommodated in the housing cassette one by one. A transporting path for transporting the recording medium 9 is formed between the paper feeding device and the imaging device 2. Although the recording medium 9 is not particularly restricted if a transport in an image forming apparatus and a transfer of a toner image can be carried out, there is mainly used a sheet-like recording medium such as a paper, a thick paper, a transparent sheet, a postal card or an envelope.

A basic image formation (print) is carried out by the image forming apparatus 1 in the following manner. Description will be given to a basic image forming operation to be carried out when forming a full color image which is constituted in combination of the toner images having the four colors (Y, M, C, K) over a single side of the recording medium 9.

Upon receipt of an instruction for starting a printing operation in the image forming apparatus (actually, a control device) 1, the photosensitive drums 21 of the imaging devices 20 (Y, M, C, K) and the paper transport belt 31 of the paper transport device 3 are started to be rotated, and furthermore, each charging device 22 in the imaging device 20 charges the image holding surface of each of the photosensitive drums 21 to have a predetermined polarity and potential. Subsequently, the exposing device 23 carries out an exposure based on an image signal transmitted from the image processing device (not shown) over the image holding surface of the photosensitive drum 21 thus charged. Consequently, an electrostatic latent image for each color component having a predetermined potential difference from a charging potential is formed on the image holding surface of each of the photosensitive drums 21. Then, the developing device 24 supplies, from the developing roll 24*a*, a toner charged to have a predetermined polarity and thus develops the electrostatic latent image, thereby forming a toner image. In the developing device 24, an inverting phenomenon is carried out. Thus, a toner image having each color (Y, M, C, K) is exclusively formed on the photosensitive drum 21 of each of the imaging devices (Y, M, C, K).

On the other hand, the recording medium 9 having a predetermined dimension and type is supplied from the paper feeding device (not shown) toward the paper transport device 3 and is then adsorbed by an electrostatic function of the adsorbing roll 35 onto the outer peripheral surface of the rotated paper transport belt 31 in accordance with a time related to the operation for forming a toner image. When the recording medium 9 is transported by the paper transport belt 31 to pass through the transfer position of each of the imaging devices 20 (Y, M, C, K), thereafter, the toner image having each color (Y, M, C, K) on the photosensitive drum 21 in the imaging device 20 is successively transferred to be superposed in order (order of Y, M, C and K) at the recording medium 9 side upon receipt of a function of an electric field formed by the transferring device 25.

Subsequently, the recording medium 9 having the toner image transferred thereto is peeled from the paper transport belt 31 and is then transported and introduced toward the fixing device 4. In the fixing device 4, the recording medium 9 having the toner image transferred thereto is heated and pressurized in a passage through the pressure contact portion NP between the heating rotor 5 and the pressurizing rotor 6 so that the toner of the toner image is molten and fixed to the recording medium 9. The recording medium 9 obtained by ending the fixation is discharged to a paper discharging portion (not shown) and is accommodated therein in the case in which an image is simply formed on either of sides thereof.

Thus, the basic (ordinary) printing operation for a single recording medium is ended. In the case in which an instruction for continuously printing a plurality of sheets is given, furthermore, the serial operation is repeated in the same manner corresponding to the number of the sheets to which the instruction is given.

Next, details of the fixing device 4 will be described.

Figure 2:
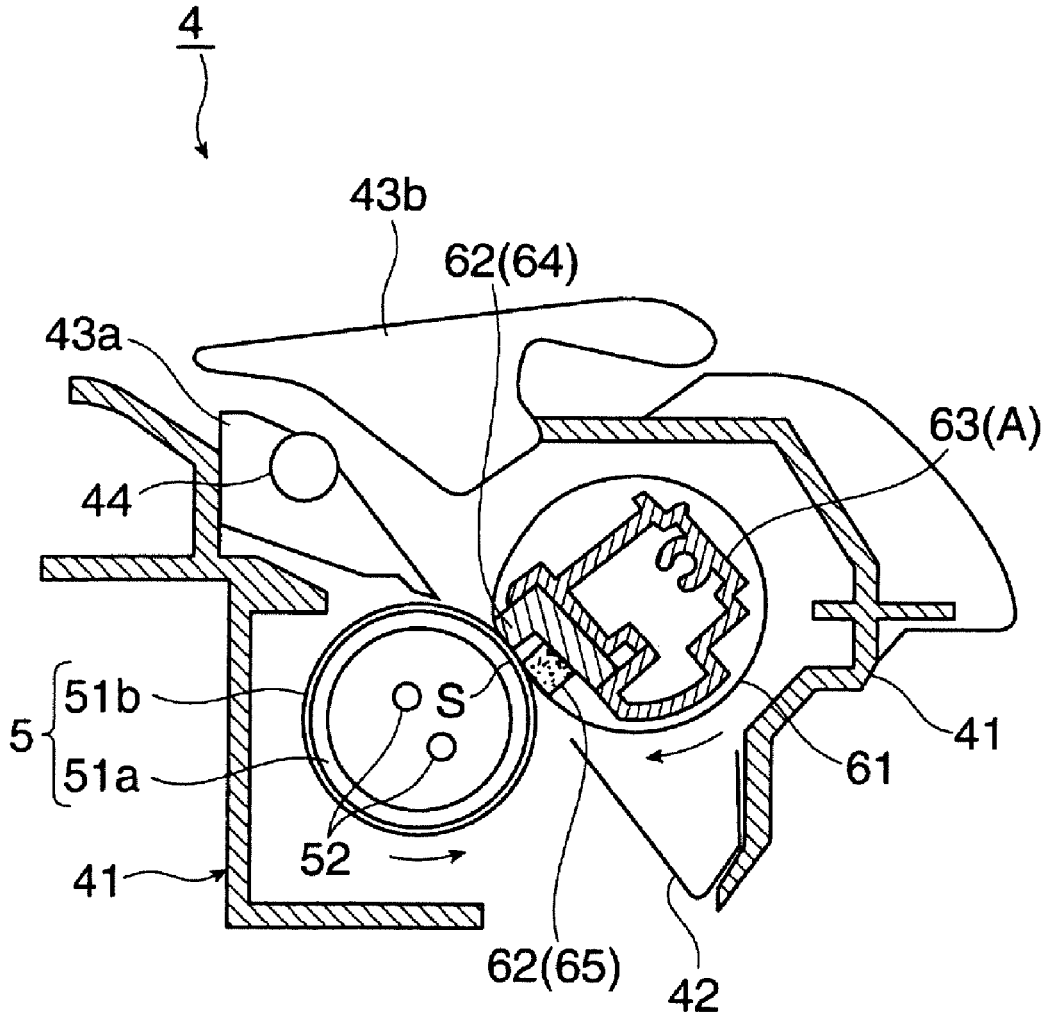
FIG. 2 is an explanatory view showing a main part of the fixing device in FIG. 1, a part of which is taken away.

In the fixing device 4, the heating rotor 5 taking the roll configuration and the pressurizing rotor 6 taking the belt configuration are provided in the housing 41 as shown in FIG. 2. In FIG. 2, the reference numeral 42 denotes a transporting and introducing plate for introducing the recording medium 9 to be a fixing target into the pressure contact portion NP, the reference numerals 43*a* and 43*b* denote a transport guide rib for forming a discharging passage, and the reference numeral 44 denotes a transport aiding roller.

The heating rotor 5 taking the roll configuration is mainly constituted by a heating roll 51, a heating source 52 for heating the heating roll 51, and a fixing and supporting frame (not shown) for rotatably supporting the heating roll 51 at both ends thereof.

In the heating roll 51, an elastic layer 51*b* constituted by a material such as a silicone rubber and a mold releasing layer constituted by a material such as a fluororesin (not shown) are formed in this order over a surface of a metallic cylindrical roll base material 51*a* which has a greater length than a maximum transporting width of the recording medium 9 to be the fixing target. Moreover, a rotating power is transmitted from a rotating and driving portion disposed on the body side of the image forming apparatus 1 to a gear 55 attached to one of ends of the heating roll 51 so that the heating roll 51 is rotated and driven at a predetermined speed.

For example, the heating source 52 is constituted by two halogen lamps disposed in the cylinder of the heating roll 51 and both ends thereof are supported on the housing 41 of the fixing device 4. In the heating roll 51, furthermore, a temperature of the surface thereof is detected by a temperature detector which is not shown and a heating operation of the heating source 52 is controlled based on information about the detection. Consequently, the surface of the roll is maintained to be heated to a predetermined temperature.

Figure 3:
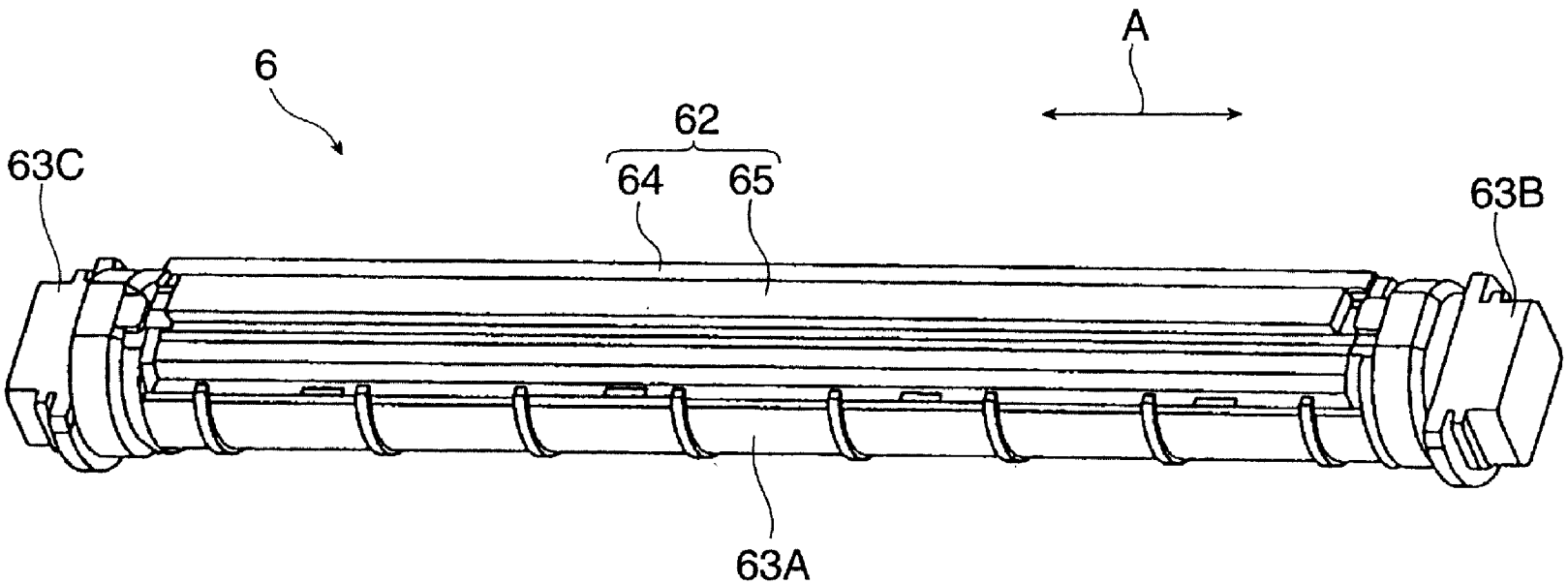
FIG. 3 is a perspective view showing a pressurizing rotor (a part thereof is omitted) in the fixing device of FIG. 2.

As shown in FIGS. 2 to 5, the pressurizing rotor 6 taking the belt configuration is mainly constituted by an endless belt 61 to be rotated in contact with an outer peripheral surface part in a rotating axis direction A of the heating roll 51 (see FIG. 3), a pressurizing member 62 for pushing the endless belt 61 against the outer peripheral surface part of the heating roll 51 at an inner peripheral surface side, thereby forming the pressure contact portion NP, and a holding member 63 disposed in an internal space of the endless belt 61 and serving to support the pressurizing member 62 and to rotatably hold the endless belt 61. In FIG. 3, the endless belt 61 and a supporting plate (63D) are not shown.

The endless belt 61 is a cylindrical belt having a width which is almost equal to the length of the heating roll 51. For the endless belt 61 to be used, a mold releasing layer constituted by a fluororesin is provided on an outer peripheral surface of a belt base material which is formed to take a thin cylindrical shape by a synthetic resin such as polyimide.

As shown in FIGS. 2 to 5, the pressurizing member 62 is constituted by a head member 64 taking a slender shape having an almost equal length to the width of the endless belt 61, and a pad member 65.

The head member 64 is a hard pressurizing member formed by a material such as a synthetic resin or a metal and is disposed in a position at a downstream side in a passing direction B of the recording medium 9 in the pressure contact portion NP (a discharging side of the recording medium). In the embodiment, the head member 64 is formed to take a shape having a protruded portion 64*a* positioned on the downstream side in the passing direction B of the recording medium 9 and serving to cause the endless belt 61 to come in pressure contact with the outer peripheral surface of the heating roll 51, and a holding portion 64*b* positioned on an upstream side in the passing direction B of the recording medium 9 and serving to hold the pad member 65. Moreover, the protruded portion 64*a* is provided with a planar portion 64*a*-1 for holding a smoothness of the pressure contact portion NP at the side of the holding portion 64*b*, and a curved slant surface 64*a*-2 which is slanted in a curving state in such a direction as to separate from the heating roll 51 in a formation of the pressure contact portion NP at an opposite side to the holding portion 64*b* in the planar portion 64*a*-1 (see FIG. 7).

The pad member 65 is a soft pressurizing member which is formed by an elastic material such as a rubber material and is disposed in a position at the upstream side in the passing direction B of the recording medium 9 in the pressure contact portion NP (an introducing side of the recording medium). In the embodiment, the pad member 65 is formed to take a slender plate-like configuration by using a silicone rubber.

The head member 64 to be the hard pressurizing member is formed to have a higher hardness than that of the elastic layer 51*b* of the heating roll 51. Moreover, the pad member 65 to be the soft pressurizing member is formed to have a lower hardness than that of the elastic layer 51*b* of the heating roll 51 and to be elastically deformed. The hardness is represented by a difference in an amount of a deformation in a pressurized part when a pressurization is carried out at a certain pressure.

Figure 4:
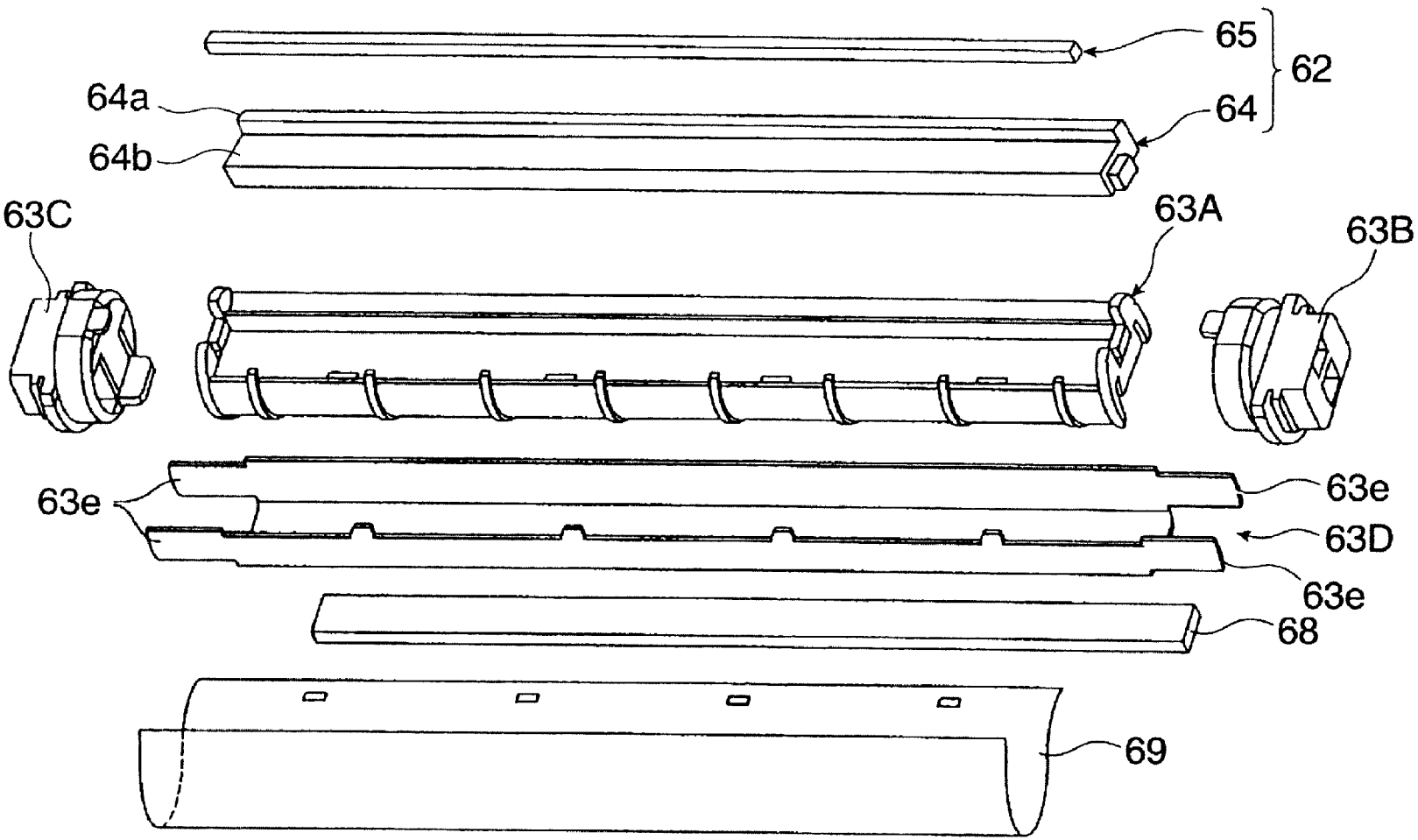
FIG. 4 is an exploded perspective view showing the pressurizing rotor in FIG. 4.

As shown in FIGS. 2 to 4, the holding member 63 includes an internal holding member 63A having an installing surface portion for installing the pressurizing member 62 (actually, the head member 64) and a belt holding portion for rotatably holding an inner peripheral surface of the endless belt 61, a pair of end holding members 63B and 63C for rotatably holding inner peripheral surface parts of both ends of the endless belt 61, and the supporting plate 63D for supporting the internal holding member 63A and the end holding members 63B and 63C. The supporting plate 63D is held in a state in which a set of two attaching ends 63*e* formed with a protrusion from the both ends are inserted into attaching holes formed on a rock supporting frame 71 in the pressurizing rotor 6 which will be described below.

Moreover, the reference numeral 68 in FIG. 4 denotes an oil supplying member attached to a back face of the supporting plate 63D to come in contact with the inner peripheral surface of the endless belt 61, and is constituted by a felt member impregnated with a mold releasing agent oil, for example. The inner peripheral surface of the endless belt 61 is coated with the mold releasing agent oil. Moreover, the reference numeral 69 denotes a film member which is formed by a synthetic resin and is disposed between the inner peripheral surface of the endless belt 61 and the pressurizing member 62, and serves to reduce a friction between the endless belt 61 and the pressurizing member 62.

The pressurizing rotor 6 is held, through the supporting plate 63D of the holding member 63, on the rock supporting frame 71 (an almost central part) to be rocked by using, as a fulcrum, a supporting shaft 72 disposed in a position at the introducing side of the recording medium. The pressurizing rotor 6 is pushed to be moved in such a direction as to approach the heating rotor 5 side by a predetermined pressurizing force F through a pressurizing spring 73 connected to a free end 71*a* of the rock supporting frame 71. Consequently, there is obtained a structure in which the pressurizing member 62 is pushed against the inner peripheral surface of the endless belt 61 through the holding member 63 to apply a predetermined pressure to the pressure contact portion NP.

Figure 5:
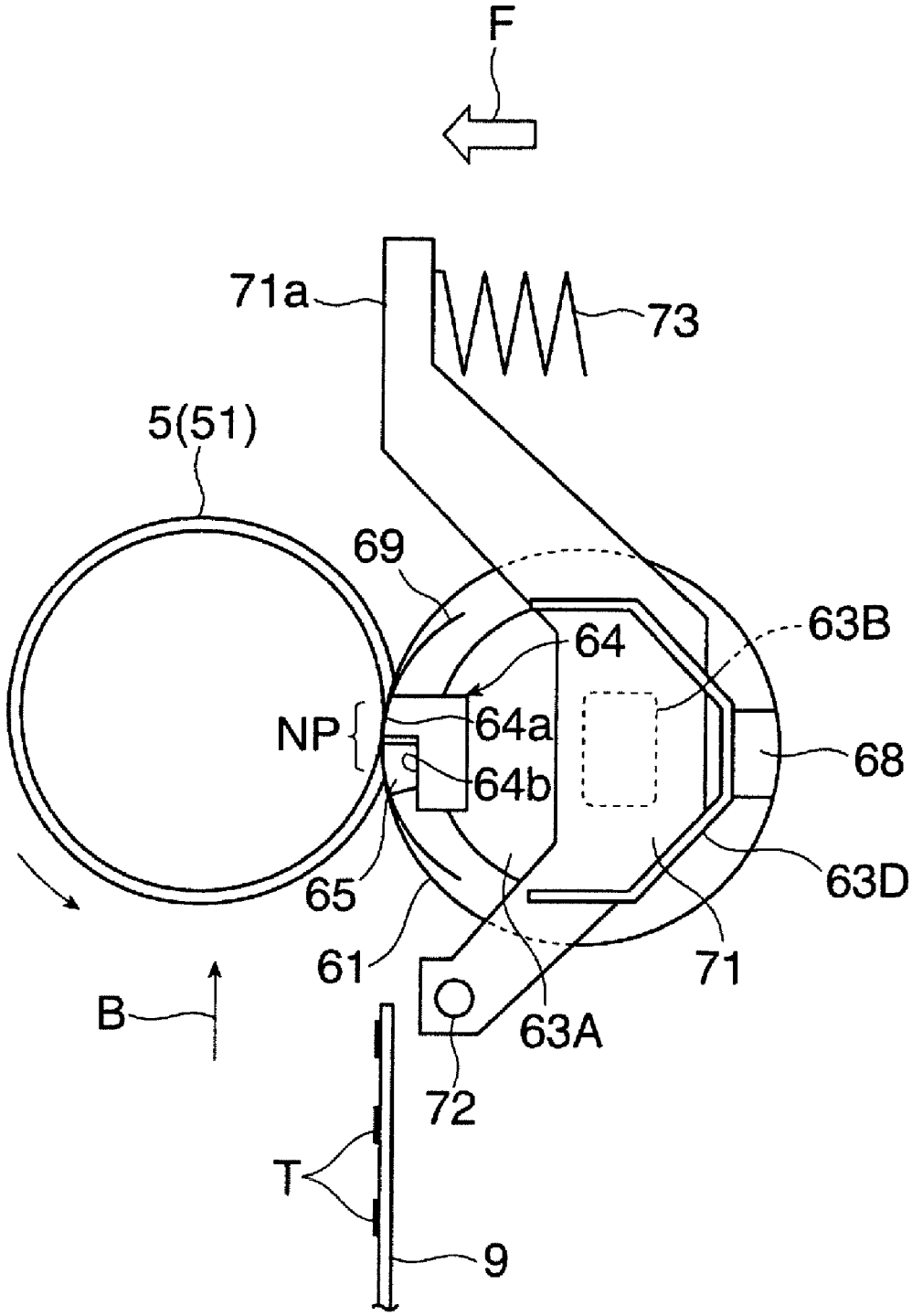
FIG. 5 is an explanatory view showing a main part of the fixing device in FIG. 2.

In the fixing device 4, as shown in FIG. 2 or 5, the pressurizing member 62 pushes the endless belt 61 against the heating roll 51 so that the fixing pressure contact portion NP in which the endless belt 61 comes in contact with the outer peripheral surface of the heating roll 51 in a predetermined width (a length in a rotating direction) is formed between the heating roll 51 and the endless belt 61 (the pressurizing member 62). At this time, the pressure contact portion NP is formed in a state in which both the head portion 64 and the pad portion 65 in the pressurizing member 62 come in contact with the outer peripheral surface of the heating roll 51 through the endless belt 61.

When the heating roll 51 is rotated as shown in FIG. 2, moreover, the endless belt 61 is rotated in a direction shown in an arrow to follow the rotation. When the endless belt 61 is rotated, the mold releasing agent oil is successively coated and supplied in a small amount from the felt member 63 to the inner peripheral surface of the endless belt 61 as shown in FIG. 5.

A fixation in the pressure contact portion NP is carried out in the following manner.

Figure 6:
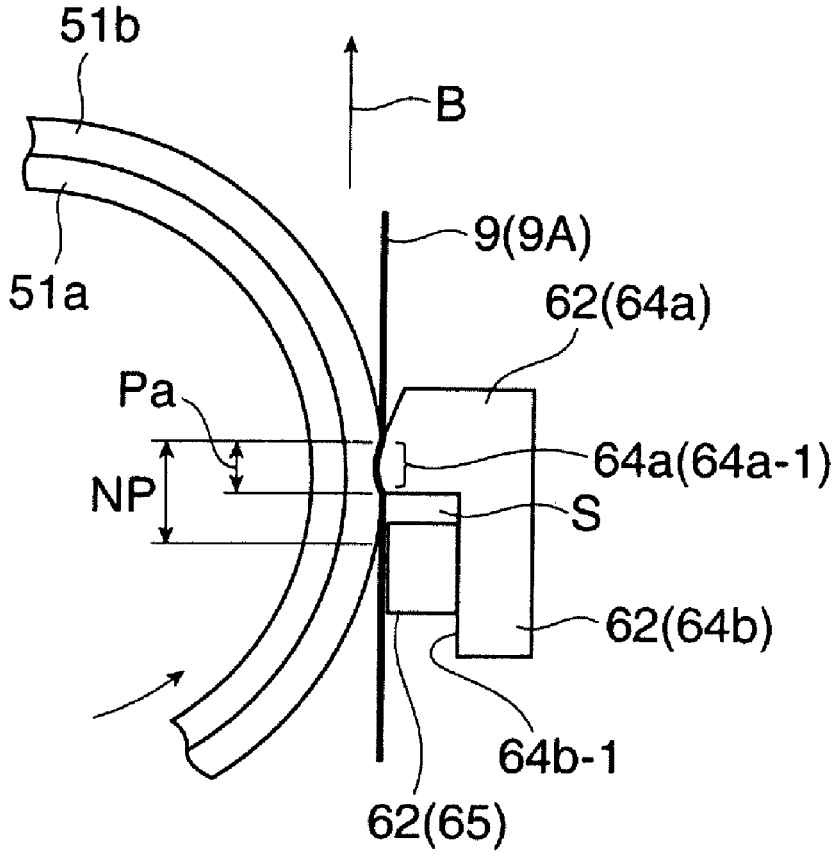
FIG. 6 is an explanatory view showing a pressure contact portion of the fixing device in FIG. 2 and a surrounding state thereof.

More specifically, as shown in FIG. 5 or 6, when the recording medium 9 holding an unfixed toner image T to be a fixing target is introduced into the pressure contact portion NP, the pad portion 65 to be the soft pressurizing member which is disposed on the recording medium introducing side of the pressure contact portion NP first pushes the recording medium 9 against the heating roll 51 (through the endless belt 61). Subsequently, (the contact portion 64*a* of) the head portion 64 to be the hard pressurizing member disposed on the recording medium discharging side of the pressure contact portion NP strongly pushes the recording medium 9 against the heating roll 51 (through the endless belt 61).

The recording medium 9 holding the unfixed toner image at this time is heated in a state in which it is pushed against the outer peripheral surface of the heating roll 51 in the heating rotor 5 by means of the pad portion 65 and the head portion 64 in the pressurizing member 62 of the heating rotor 6 in the pressure contact portion NP, and furthermore, is transported to pass through the pressure contact portion NP by the rotation of the heating roll 51. As a result, when the recording medium 9 passes through the pressure contact portion NP, the unfixed toner image is heated and pressurized and is thus fixed onto the recording medium 9.

In the image forming apparatus 1, a specific recording medium 9A taking a bag-like configuration such as an envelope can be used as the recording medium 9, and the image forming operation can be executed over the specific recording medium 9A to form an image.

In some cases in which the image is formed on the specific recording medium 9A such as the envelope, however, an unnecessary crease is generated on a rear end at an upstream side in a transporting direction of the recording medium 9A after a passage through the fixing device 4.

Figure 20:
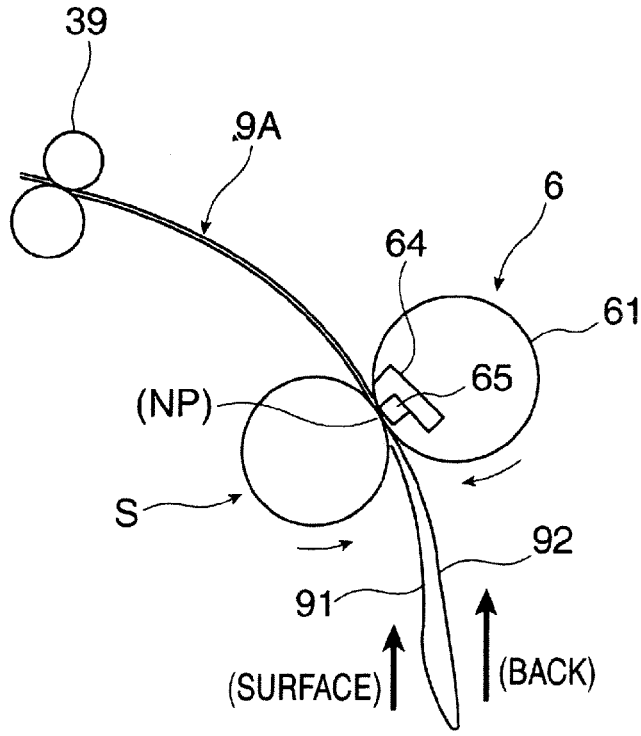
FIG. 20 is an explanatory view showing a cause of an envelope crease generated in a fixing device using a pressurizing member having no clearance.

Referring to the generation of the crease, as shown in FIG. 20, for example, when the envelope is to be discharged via the pressure contact portion NP between the heating roll 51 of the heating rotor 5 and the pressurizing rotor 6 taking the belt configuration, it is transported in a curving state in accordance with a curvature of the outer peripheral surface part of the heating roll 51 passing through the pressure contact portion NP so that a very small difference is made in a moving speed between a surface 91 and a back face 92 in an overlapping state of the envelope (a moving speed in an overlapping part on a side provided apart from the heating roll 51 is higher than a moving speed in an approaching side part). Consequently, it can be supposed that a slack is generated on a surface (for example, the surface 91) at a side where the moving speed is relatively low on a rear end side of the envelope introduced into the pressure contact portion NP later and the slack part is finally crushed when passing through the pressure contact portion NP, resulting in the crease.

Figure 21:
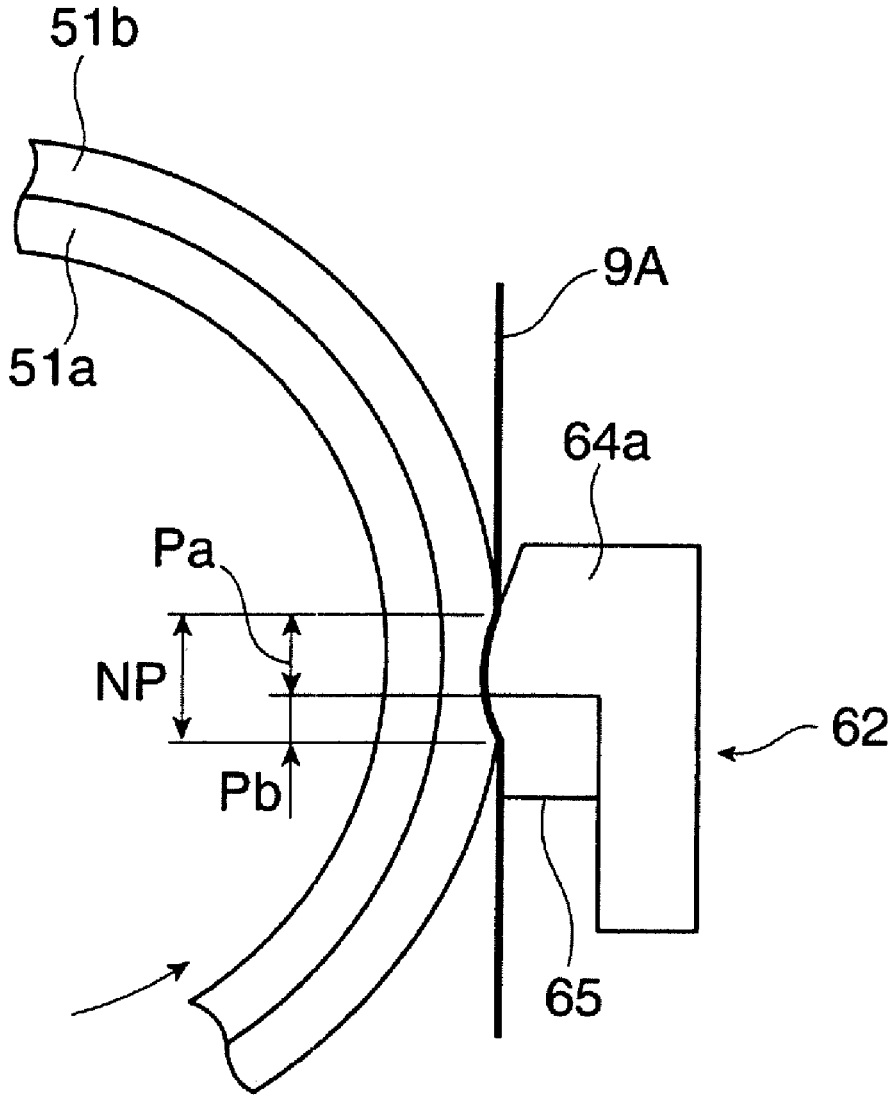
FIG. 21 is an explanatory view showing a state of a pressure contact portion through the pressurizing member in FIG. 20.

In the outer peripheral surface part of the heating roll 51 passing through the pressure contact portion NP in the conventional fixing device 4, the elastic layer 51*b* of the heating roll 51 is dented to be curved in an almost whole region of the pressure contact portion NP by pushing the head member 64 and the pad member 65 in the pressurizing member 62 as shown in FIG. 21. The specific recording medium 9A is caused to pass through the pressure contact portion NP in conformity with a curvature of the curved and dented part of the elastic layer 51*b* in the heating roll 51 in the fixation. There is a tendency that the moving speed difference from the specific recording medium 9A is increased when the curvature is increased.

Figure 7:
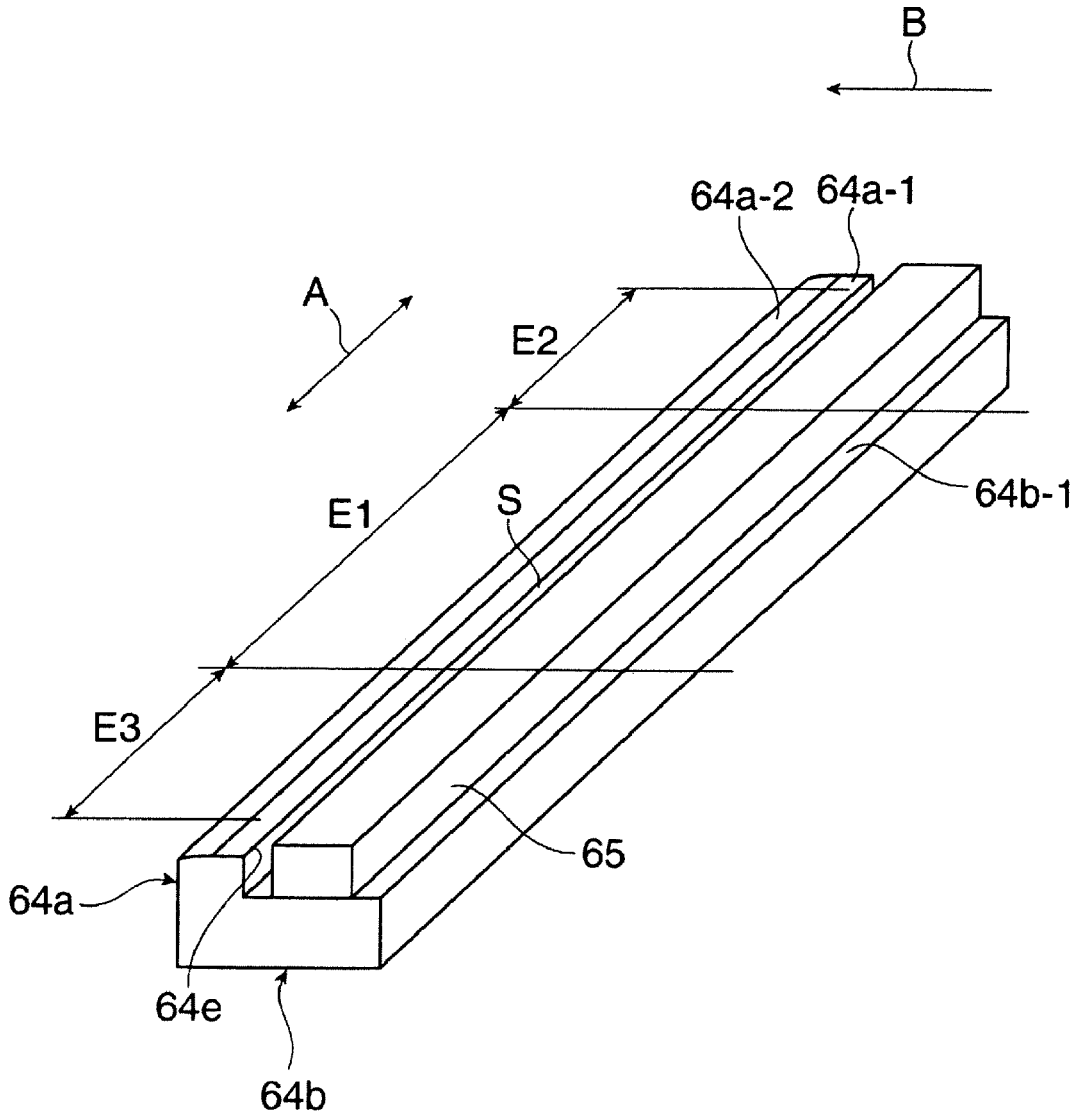
FIG. 7 is a perspective view showing structures of a head member and a pad member which constitute a pressurizing member in the fixing device of FIG. 2.

In the fixing device 4 of the image forming apparatus 1, (the protruded portion 64*a* of) the head member 64 and the pad member 65 which constitute the pressurizing member 62 are provided in the following manner as a countermeasure to be taken for suppressing the generation of the crease in the case in which the specific recording medium 9A is used as shown in FIG. 6 or 7.

More specifically, (the protruded portion 64*a* of) the head member 64 and the pad member 65 are disposed in a state in which a clearance S is present between both of them (64*a* and 65) in a specific region part (a specific fixing region) E1 for causing at least the specific recording medium 9A such as an envelope to pass in a fixing set region E in the rotating axis direction A of the heating roll 51 in the pressure contact portion NP.

The specific fixing region E1 corresponds to (a width of) a passing region in the pressure contact portion NP in which the specific recording medium 9A such as the envelope is preset to pass in a fixation thereof. In the case in which there is employed a transporting method of carrying out a regulation related to the transporting position of the recording medium 9 by setting a central position of the fixing set region E of the pressure contact portion NP in the fixing device 4 as a reference position in a transport, that is, a so-called center registration method, moreover, the specific fixing region E1 has normal fixing regions E2 and E3 on both sides thereof if a feeding width of the specific recording medium 9A is not a maximum size in the recording medium 9 which is applicable (see FIG. 7). In the normal fixing regions E2 and E3, (the protruded portion 64*a* of) the head member 64 and the pad member 65 may be disposed in a state in which the clearance S is not present between both of them or is present between both of them.

Figure 8:
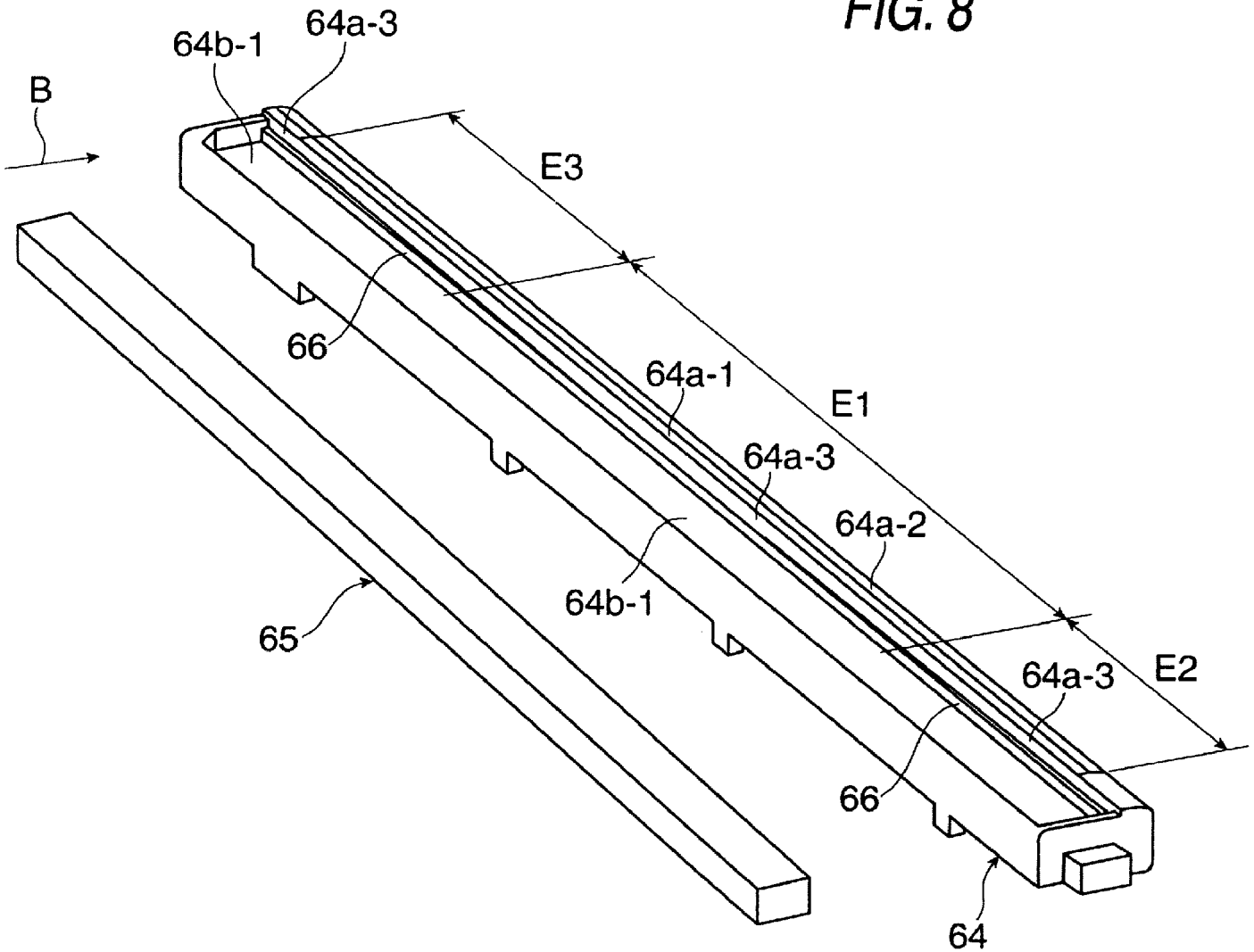
FIG. 8 is an exploded perspective view showing the pressurizing member of FIG. 7.
Figure 9:
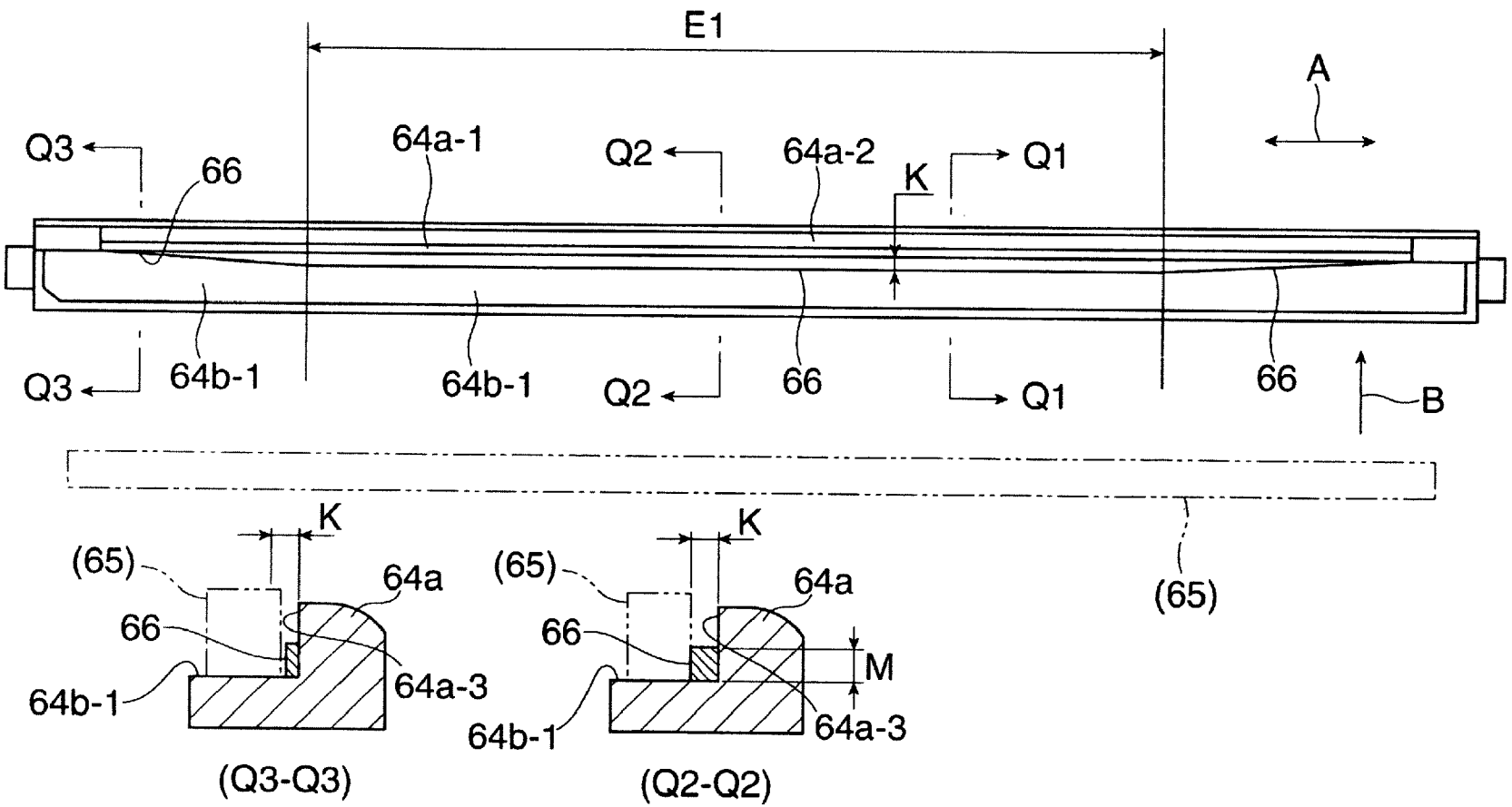
FIG. 9 is top and sectional views showing the head member of the pressurizing member in FIG. 7.
Figure 10:
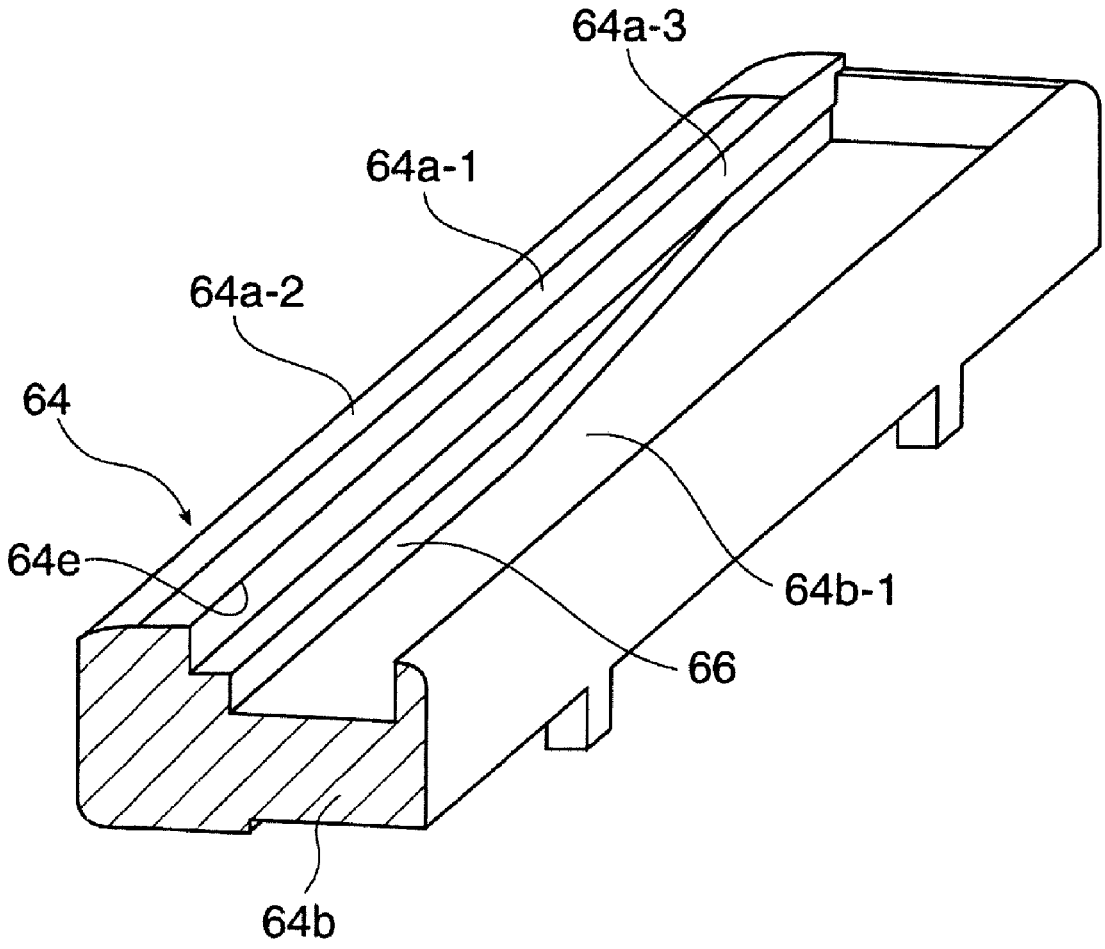
FIG. 10 is a perspective sectional view taken along a Q1-Q1 line in the head member of the pressurizing member in FIG. 9.

In the embodiment, in order to dispose them in the state in which the clearance S is present, a member having a gap holding portion 66 formed in a boundary portion between the protruded portion 64*a* and the holding portion 64*b* (a portion in which a planar erected wall surface 64*a*-3 of the protruded portion 64*a* crosses a planar installing surface 64*b*-1 of the holding portion 64*b*) is used as the head member 64, while a member taking a shape of a linearly rectangular parallelepiped is used as the pad member 65 as shown in FIGS. 8 to 10.

Furthermore, the gap holding portion 66 is formed in a state in which a part having a thickness K (a dimension in the passing direction B of the recording medium) corresponding to the gap S to be held on the installing surface 64*b*-1 of the pad member holding portion 64*b* in at least the normal fixing regions E2 and E3 is present. In particular, the gap holding portion 66 in the example is formed to take such a shape that the thickness K is gradually increased with a shift from the two normal fixing regions E2 and E3 on both ends toward the specific fixing region E1 in the central part (a corresponding part to the fixing region E1 has an almost equal thickness). Furthermore, the gap holding member 66 is formed in a height (a thickness) M which is smaller than a step (a height difference) between the protruded portion 64*a* and the installing surface 64*b*-1 of the holding portion 64*b* in the head portion 64.

The reason why there is formed the gap holding portion 66 taking a configuration in which the thickness K is different in the rotating axis direction A of the heating roll 51 is that the clearance S between (the protruded portion 64*a* of) the head member 64 and the pad member 65 is to be reliably maintained in the specific fixing region E1. In the case in which the fixation to the recording medium 9A to be a thick paper including an envelope is carried out, moreover, it is necessary to prevent a damage from being caused due to a pressure contact of a tip part in the passing direction of the recording medium 9A with the surface of the elastic layer 51*b* of the heating roll 51. In addition, the reason why the gap holding portion 66 is formed in the small height (thickness) M is that a space for a sufficiently elastic deformation is to be maintained when the pad member 65 forms the pressure contact portion.

The pad member 65 is disposed in a fixing state, through fixing unit such as bonding, to the installing surface 64*b*-1 of the head member 64 on which the gap holding portion 66 is formed so that the pressurizing member 62 is thus finished. Consequently, the pad member 65 is disposed and held in a state in which the interval K from the protruded portion 64*a* of the head member 64 (actually, the erected wall surface 64*a*-3) (with respect to the passing direction B of the recording medium) is formed through the presence of the gap holding portion 66 having a maximum thickness of K (see FIG. 9).

Figure 11A:
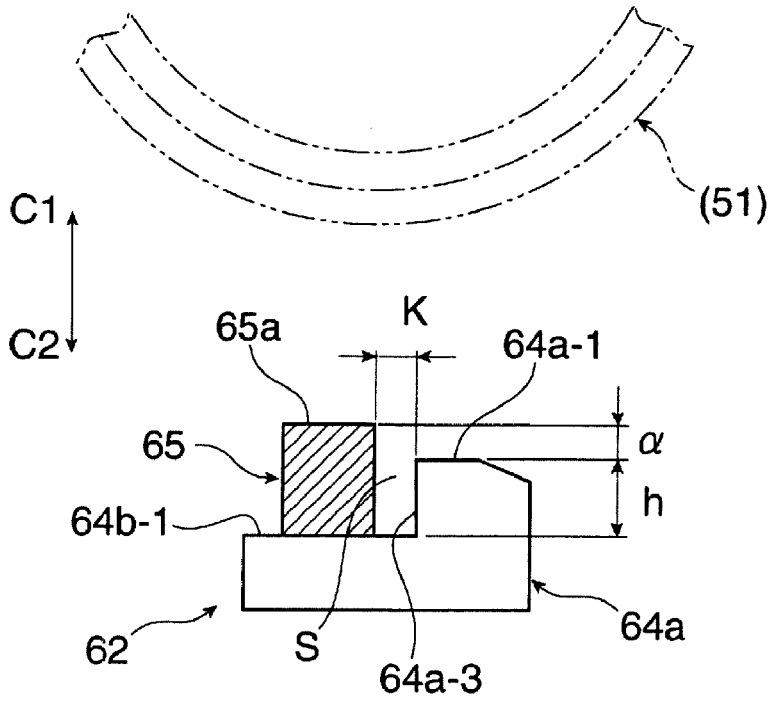
FIGS. 11A and 11B are explanatory views showing a state in which the pressurizing member in FIG. 7 has not been assembled yet (is disassembled) and a state brought when the pressurizing member is assembled and caused to come in pressure contact with a heating roll through an endless belt.

Referring to the pad member 65, moreover, a pressure contact surface portion 65*a* forming the pressure contact portion NP is maintained in a protruding state so as to be present in an approaching direction (a direction shown in an arrow C1) to the heating roll 51 from the closest surface part to the heating roll 51 (the plane portion 64*a*-1 of the protruded portion 64*a*) in a formation of the pressure contact portion NP in the head member 65 when the pressurizing member 62 separates the endless belt 61 from the heating roll 51 so that the pressure contact portion NP is not formed before the pressurizing rotor 6 is assembled or when it is disassembled as shown in FIG. 11A, for example.

In other words, the pad member 65 is formed and disposed in such a thickness (a height: a dimension from the installing surface 64*b*-1) that the pressure contact surface portion 65*a* is protruded by a predetermined protruding amount a from the plane portion 64*a*-1 of the protruded portion 64*a* in the head member 64. The designation h in FIG. 11A denotes a height of the plane portion 64*a*-1 of the protruded portion 64*a* in the head member 64 from the installing surface portion 64*b*-1 of the plane portion 64*a*-1. For this reason, the pad member 65 to be applied is formed in such a dimension that at least a thickness of the pressure contact surface portion 65*a* in a non-pressurizing state is greater than the height h of the plane portion 64*a*-1 of the protruded portion 64*a* in the head member 64.

Figure 11B:
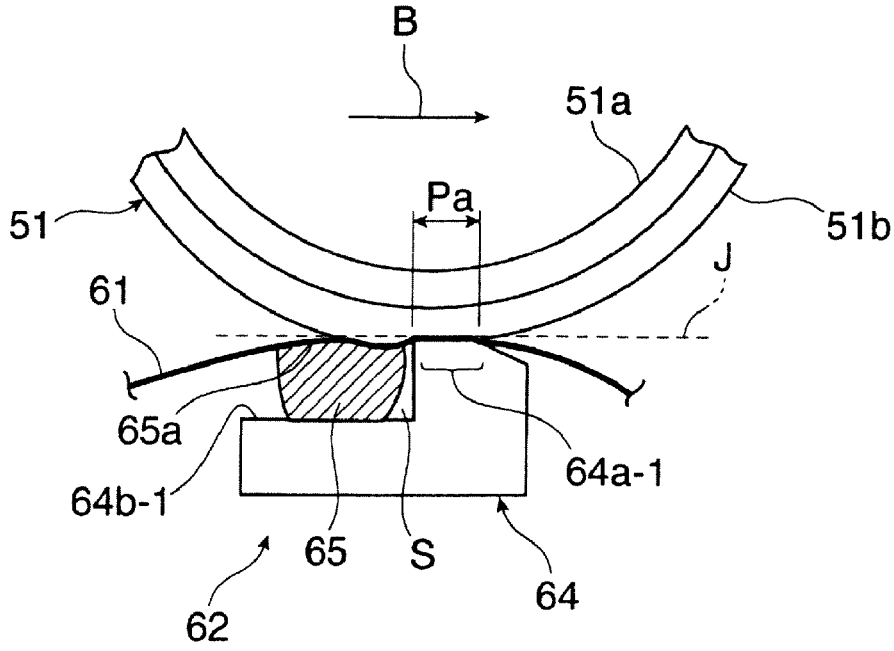

In addition, the pad member 65 is set into a state in which it is elastically deformed and compressed to be present in a separating direction apart from the heating roll 51 (a direction of an arrow C2) as compared with the surface part of the head member 64 (the plane portion 64*a*-1 of the protruded portion 64*a*) when the pressurizing member 62 pushes the endless belt 61 against the heating roll 51 to form the pressure contact portion NP after the pressurizing rotor 6 is assembled as shown in FIG. 11B. A one-dotted chain line J in FIG. 11B indicates a height position of the plane portion 64*a*-1 of the protruded portion 64*a*.

In particular, the pad member 65 is constituted by the soft member to be elastically deformed with a lower hardness than that of the elastic layer 51*b* of the heating roll 51 as described above. When the pressurizing member 62 pushes the endless belt 61 against the heating roll 51 to form the pressure contact portion NP, therefore, the pad member 65 is elastically deformed and compressed upon receipt of a reaction force from the elastic layer 51*b*. Furthermore, the protruded portion 64*a* of the head member 64 cuts into the elastic layer 51*b* at this time. Therefore, the pressure contact surface portion 65*a* of the pad member 65 is present in a separating direction apart from the heating roll 51 as compared with the plane portion 64*a*-1 to be the surface part of the head member 65.

In the fixing device 4, in the stage in which the pressurizing rotor 6 is assembled and disposed to form the pressure contact portion NP between the pressurizing rotor 6 and the heating roll 51, the clearance S is present between the head member 64 and the pad member 65 in the pressurizing member 62 as shown in FIG. 6 or 11B.

At this time, the pad member 65 is elastically deformed to be compressed upon receipt of the reaction force of the elastic layer 51*b* of the heating roll 51. By the presence of the gap holding portion 66, however, the pad member 65 is rarely deformed with a square section maintained as illustrated in FIG. 6. Actually, the pad member 65 is deformed in a state in which the upper part of the pressure contact surface portion 65*a* having no gap holding portion 66 is greatly crushed to also enter the space of the clearance S as shown in FIG. 11B. Consequently, the clearance S present between the head member 64 and the pad member 65 is caused to be smaller than the thickness K of the gap holding portion 66 before the assembly or installation.

Figure 12:
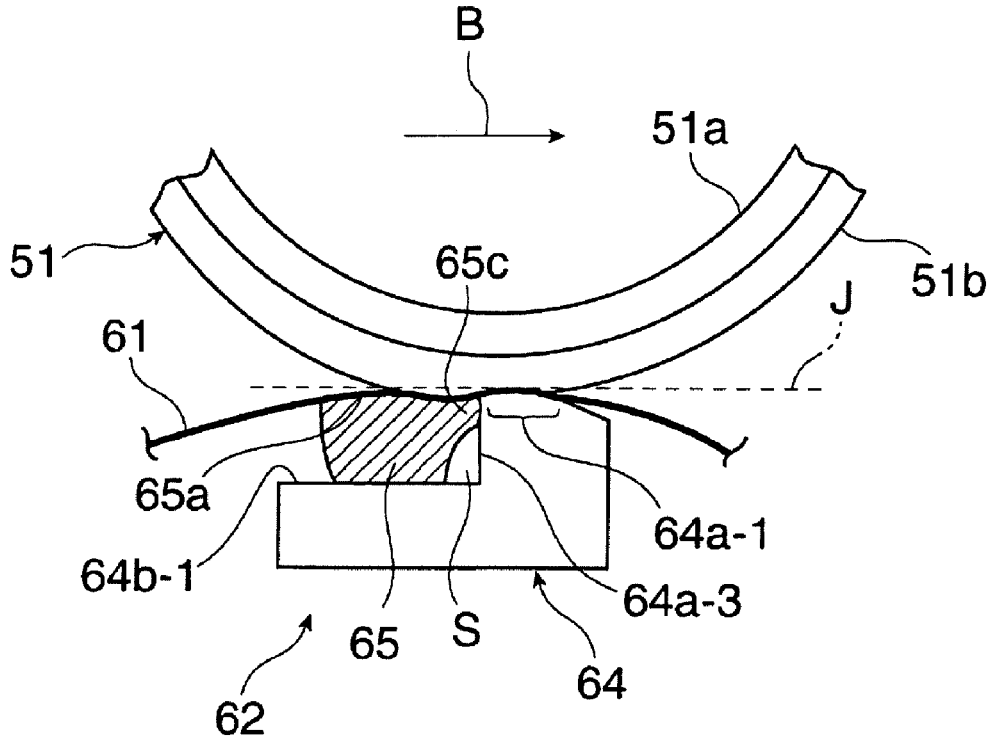
FIG. 12 is an explanatory view showing a variant of the state in which the pressurizing member in FIG. 7 is assembled and caused to come in pressure contact with the heating roll through the endless belt.

Also in the case in which the elastic deformation is carried out, there is no problem in that a part (65*c*) of the pad member 65 is elastically deformed to come in contact with a part (the wall surface 64*a*-3) of the head member 64 as illustrated in FIG. 12, and it is sufficient that the elastic deformation is performed to slightly leave the clearance part between of them. In other words, it is preferable that the clearance (S) between the protruded portion 64*a* of the head member 64 and the pad member 65 should not be perfectly filled to disappear but should be left also in a state in which the pressurizing rotor 6 is assembled or a fixing operation.

By the presence of the clearance S, in the pressure contact portion NP, the force of the pad member 65 to push the endless belt 61 against the elastic layer 51*b* of the heating roll 51 is reduced so that the force of the protruded portion 64*a* of the head member 64 to push the endless belt 61 and the elastic layer 51*b* is correspondingly increased. As a result, the deformation of the elastic layer 51*b* of the heating roll 51 in the pressure contact portion NP is relatively increased in a part pushed by the protruded portion 64*a* of the head member 64. A part (a range) indicated as Pa in FIG. 6 or 11 serves as a pressure contact portion range formed by a push of the protruded portion 64*a* (mainly, the plane portion 64*a*-1) in the pressure contact portion NP.

Accordingly, the elastic layer 51*b* of the heating roll 51 in the passage through the pressure contact portion NP takes a shape curved like almost S as a whole by putting together an original part taking a cylindrical shape which is formed in a relationship with the cylindrical roll base member 51*a* (a corresponding part to a pressure contact portion Pb formed between the pad member 65 and the elastic layer 51*b*) and a deformed (compressed) part having an opposite curvature to a cylindrical shape formed by pushing through the protruded portion 64*a* of the head member 64. When the specific recording medium 9A such as an envelope passes through the pressure contact portion NP, consequently, a difference in a moving speed in a surface and a back face is reduced so that a crease can be prevented from being generated.

When the force of the pad member 65 to push the endless belt 61 against the elastic layer 51*b* of the heating roll 51 is reduced as described above, moreover, a width of the pressure contact portion NP (a length in the passing direction B of the recording medium 9A) is decreased. In the pressure contact portion NP, however, the pad member 65 is disposed, assembled and attached in a state in which it is protruded from the plane portion 64*a*-1 of the protruded portion 64*a* in the head member 64 (see FIG. 11B) so that the width of the pressure contact portion NP can be maintained fully and an excellent fixing performance can be obtained.

From the foregoing, according to the fixing device 4, it is possible to carry out an excellent fixation having no generation of a crease over the specific recording medium 9A such as the envelope. According to the image forming apparatus 1 using the fixing device 4, moreover, it is possible to carry out an excellent image formation without a fixing failure caused by the generation of the crease or a deterioration in the fixing performance.

For reference, in the case in which the head member 64 and the pad member 65 are not disposed with the clearance S as shown in FIG. 21, a space for a free deformation is not present on the pad member 65 side in an elastic deformation to carry out a compression upon receipt of the reaction force of the elastic layer 51*b* of the heating roll 51. Therefore, the elastic deformation is brought into a state in which the hardness is increased through the compression to carry out an aggregation close to the pad member 65 side. As a result, a degree at which the pad member 65 pushes and deforms the elastic layer 51*b* of the heating roll 51 is increased so that the range Pb for forming the pressure contact portion NP through the pad member 65 is enlarged. Thus, the curvature obtained by the deformation of the elastic layer 51*b* in the whole pressure contact portion NP is finally increased as a whole.

FIG. 13 shows a result of an evaluation test related to an effect for improving an envelope crease which was carried out by using the fixing device 4.

The evaluation test was carried out on the following conditions. There was used the heating roll 51 obtained by forming the elastic layer 51*b* (a thickness of 0.6 mm) constituted by a silicone rubber (a JIS-A rubber hardness: 40 degrees) on a metallic cylindrical roll base material having an outside diameter of 26 mm For the endless belt 61, a belt (a thickness of 60 μm) having an outside diameter of 30 mm and formed of polyimide was used. The head member 64 to be used was wholly constituted by a molded product formed by a liquid crystal polymer, and had a width of 1 to 2 mm in the plane portion 64*a*-1 of the protruded portion 64*a* and had a height h of 3 mm of the protruded portion 64*a* from the installing surface 64*b*-1 of the holding portion 64*b*. The pad member 64 which was used is formed by a silicone rubber (a hardness of Ascar C (9.8 N): 24 degrees) and takes a shape of a square bar having a width (a length in the passing direction B) of 5 mm and a thickness of 3.5 to 4.2 mm.

In the fixing device 4, the endless belt 61 is pushed against the heating roll 51 by means of the pressurizing member 62 including the head (Head) member 64 and the pad (PAD) member 65 in a state in which a load of 170 N is applied, and the pressure contact portion (Nip) NP is thus formed. The heating roll 51 is rotated at a rotating speed of 90 mm/sec and is heated to hold a surface temperature to be 180° C.

For the specific recording medium 9A, two types of envelopes (manufactured by Columbia, form: Com-10, model number: CO125, CO131) were used. Both feeding widths in a passage of the envelopes to pass through the pressure contact portion NP are 105 mm "Surface" and "Back" in FIG. 12 indicate a surface and a back face in each of the two types of envelopes.

Moreover, the center registration method is employed in the fixing device 4. Therefore, a region portion of 120 mm is maintained as the specific fixing region E1 of the pressure contact portion NP in a central part of the fixing set region E (a total width of 220 mm). The pad member 65 is disposed in each clearance (K: FIG. 9) and a protruding amount (α: FIG. 9) shown in FIG. 13 on the installing surface 64*b*-1 of the holding portion 64*b* in the head member 64, and the pressure contact portion NP is then formed. The pressure contact portion NP has a range from a point where the pad member 65 is started to come in contact with the outer peripheral surface of the heating roll 51 through the endless belt 61 to a point where the head member 64 is released from the contact of the outer peripheral surface of the heating roll 51 through the endless belt 61. In the test, a width of each pressure contact portion NP (an Nip width) was obtained by measuring a width of an uneven fixing part in a solid image (a length in the passing direction B) when introducing and stopping the recording medium 9 having the solid image preformed thereon in the pressure contact portion NP of the fixing device 4.

For the fixing device 4 having each structure, the fixation was carried out through two types of envelopes, and the envelopes subjected to the fixation were observed to examine a situation in which a crease was generated at a rear end to be an upstream side in the passing direction B. In the test, character information about a destination such as an address was formed as a toner image on the envelope to fix an unfixed toner image. The situation of the generation of the crease was evaluated based on the following reference.

Grade 0: A crease was not generated.

Grade 1: A crease was generated within a range of an inside of 10 mm from a rear end.

Grade 2: A crease was generated within a range of an inside of 20 mm from the rear end.

Grade 3: A crease was generated within a range exceeding 20 mm from the rear end.

Grade 4: Such a crease as to change a shape of the rear end was generated.

Figure 14A:
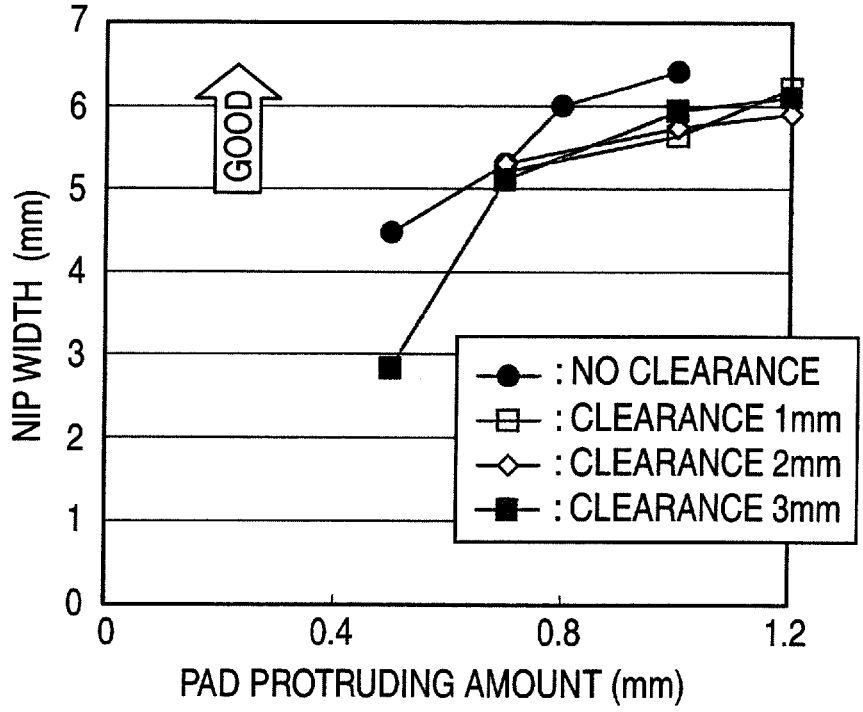
FIGS. 14A and 14B are graphs showing a part of the result of the evaluation in FIG. 13.
Figure 14B:
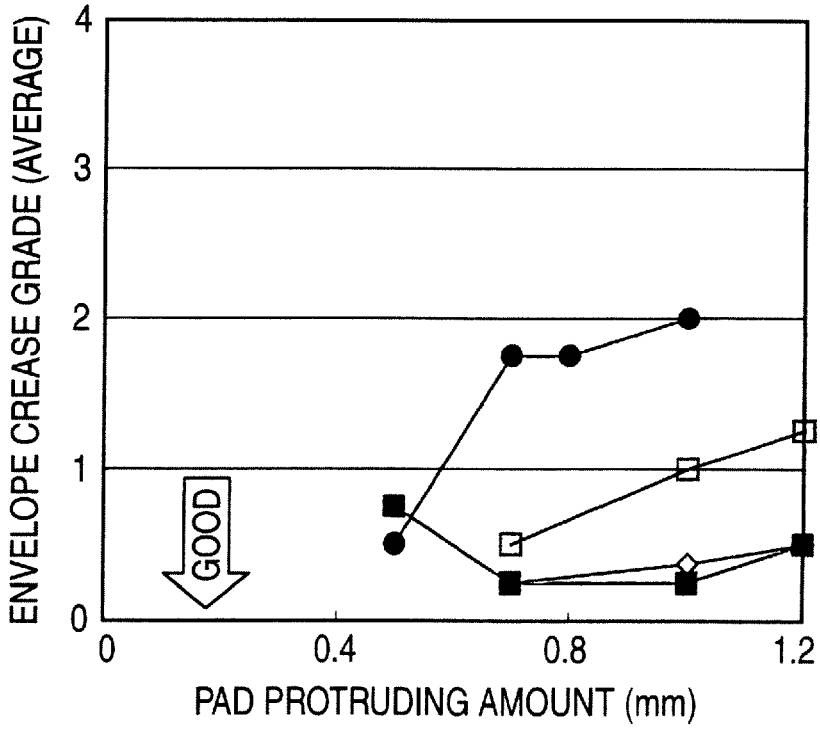

Referring to the result of the test, moreover, FIG. 14A shows a result of the width of the pressure contact portion NP with respect to the protruding amount of the pad member in a graph for each clearance. In this case, 5 mm or more is required for maintaining an excellent fixing performance. Furthermore, FIG. 14B shows a result of an evaluation grade of an envelope crease with respect to the protruding amount of the pad member in a graph for each clearance. In this case, an allowable grade which is fit for a practical use is Grade 1 or less.

Another Embodiment

In the embodiment, the pad member 65 to be used takes the shape of the square bar having a square section. In addition, it is also possible to use a member taking such a shape as to have a dimension W in a passing direction B of a recording medium increased gradually apart from a heating roll 51 as shown in FIG. 15, for example.

Figure 15:
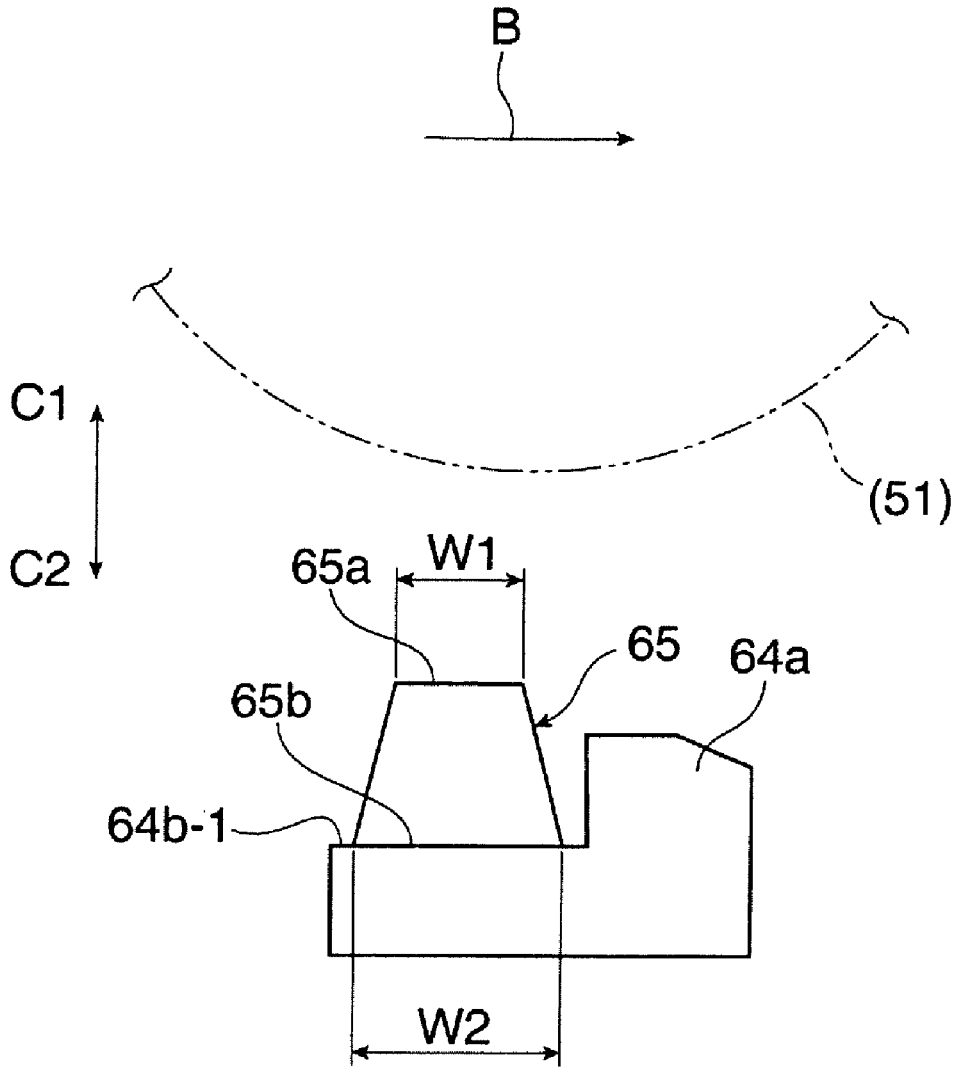
FIG. 15 is an explanatory view showing another example of the shape of the pad member.

A pad member 65 illustrated in FIG. 15 takes a trapezoidal shape in which a width W2 of an installing surface (a bottom face) 65*b* is greater than a width W1 of a pressure contact surface portion 65*a* for both of upstream and downstream sides in the passing direction B. In the case in which the pad member 65 taking the shape is used, it is hard to generate a sequentially permanent strain by an influence of a high temperature environment under a pressurization in a fixation in a pressure contact portion NP of the pad member 65. Thus, it is possible to stably maintain a state of the pressure contact portion NP over a long period of time. As a result, it is possible to obtain an effect for suppressing a generation of a crease in the fixation of a specific recording medium 9A over a long period of time. In this case, the pad member 65 may take such a trapezoidal shape that the width W2 of the installing surface 65*b* is greater than the width W1 of the pressure contact surface portion 65*a* toward the upstream or downstream side in the passing direction B.

Figure 16:
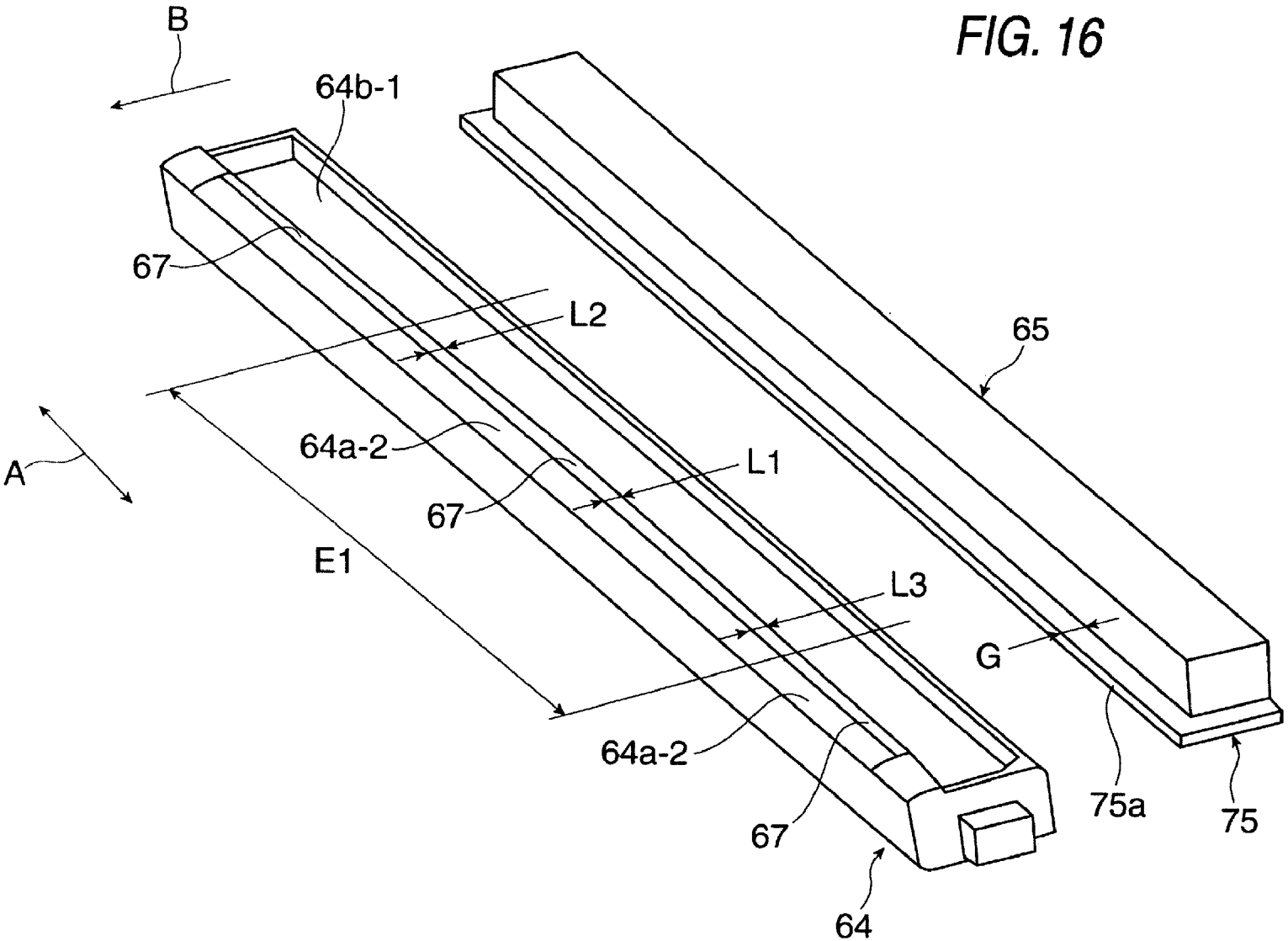
FIG. 16 is an exploded perspective view showing another example of the structure of the pressurizing member in the fixing device.
Figure 17:
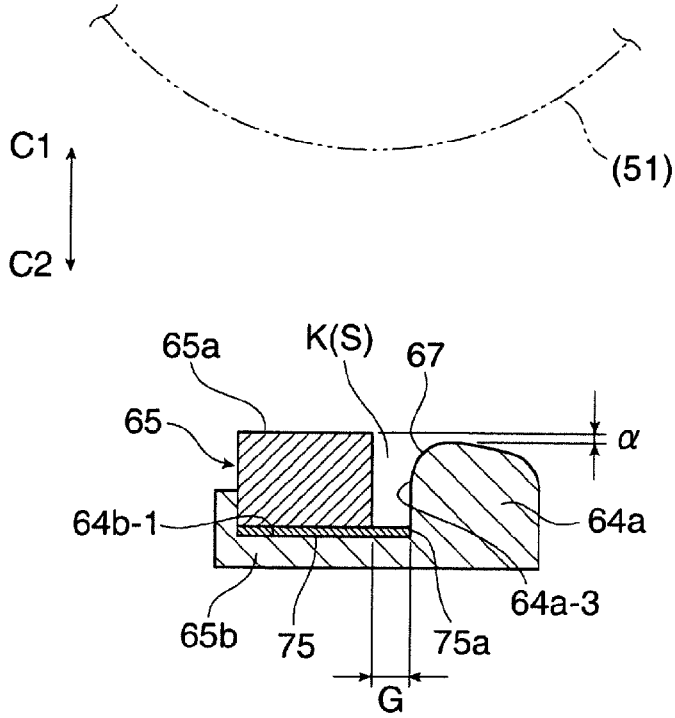
FIG. 17 is a sectional view showing a state brought after the pressurizing member of FIG. 16 is assembled.

Although there has been described the case in which the two planes (64*a*-1, 64*a*-3) are formed to cross each other at an almost right angle as a corner portion 64*e* to be the upstream side in the passing direction B of the recording medium in the protruded portion 64*a* of the head member 64 in the embodiment (see FIGS. 7 and 10), moreover, it is also possible to form the corner portion as a slant surface 67 which approaches the heating roll 51 with a shift toward the downstream side in the passing direction B as shown in FIG. 16 or 17. The slant surface 67 corresponds to a surface which is referred to as a so-called taper surface or round surface, and a planar shape thereof may be a flat surface or a curved surface.

Figure 18:
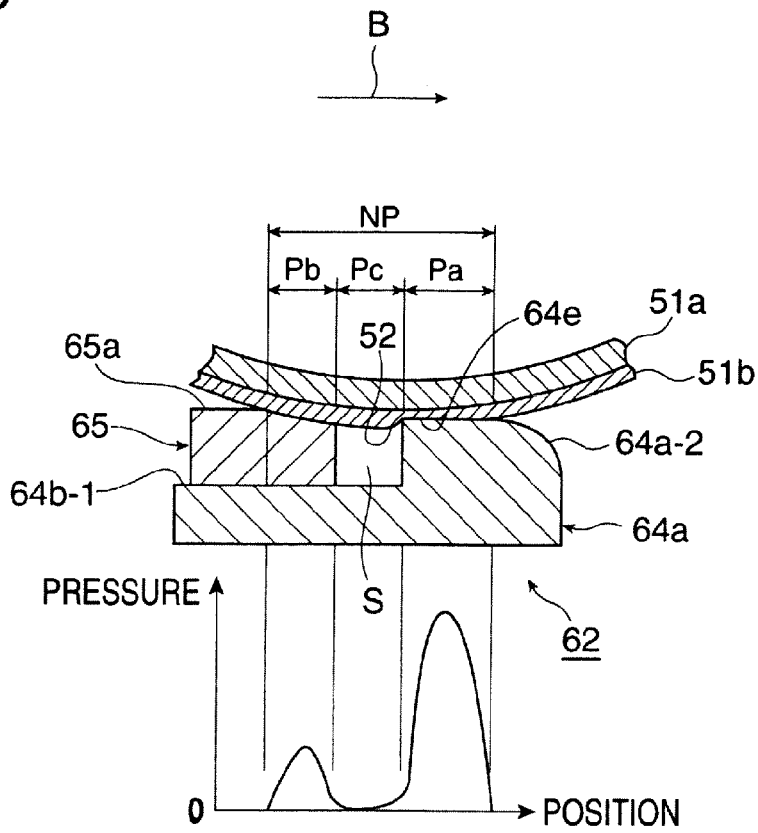
FIG. 18 is an explanatory view showing a distribution of a pressure in the pressure contact portion in the case in which a corner portion of the head member of the pressurizing member in FIG. 7 is not formed as a slant surface.

Referring to a pressure distribution in the pressure contact portion NP in a fixing device 4, as shown in FIG. 18, a pressure in a pressure contact portion Pa formed by pushing the protruded portion 64*a* of the head member 64 to be a hard pressurizing member is the highest and a pressure in a pressure contact portion Pb formed by pushing the pad member 65 to be a soft pressurizing member is relatively lower than that in the pressure contact portion Pa. However, a pushing force of a pressurizing member 62 does not directly reach a pressure in a pressure contact portion Pc corresponding to a clearance S present between the protruded portion 64*a* of the head member 64 and the pad member 65. Therefore, there is set a low pressure state in which the pressure approximates to zero. In the case in which a fixation to a recording medium 9 to be a thick paper including an envelope is carried out, therefore, a tip part of the thick paper is maintained to be strongly pushed against an elastic layer 51*b* side of the heating roll 51 when the tip part of the thick paper is introduced into the pressure contact portion NP and enters and passes through a high pressure region of the pressure contact portion Pa at a downstream side from a low pressure region of the pressure contact portion Pc. Therefore, a great load is instantaneously applied to the elastic layer 51*b* portion so that a surface of the elastic layer 51*b* is damaged. In some cases, consequently, a picture quality failure is caused by the damage.

On the other hand, in the case in which a corner portion (64*e*) to be an inlet side of the protruded portion 64*a* in the head member 64 is formed as the slant surface 67, the pressure distribution in the pressure contact portion Pa is slowly raised by the presence of the slant surface 67. When the tip part of the thick paper enters and passes through the pressure contact portion Pa, consequently, a pressure for a push toward the elastic layer 51*b* side of the heating roll 51 is reduced so that the load to be applied to the elastic layer 51*b* portion is also reduced. As a result, there is reduced a damage which is caused by the pressure contact of the tip part of the thick paper in the elastic layer 51*b* of the heating roll 51. Thus, it is possible to avoid the picture quality failure caused by the damage.

Moreover, the slant surface 67 is formed in a state in which a length L in the passing direction B of the recording medium is greater in (a length L1 of) a central part than (lengths L2 and L3 of) an end in a rotating axis direction A of the heating roll 51 in a specific fixing region E1 as shown in FIG. 16. It is preferable that the length L of the slant surface 67 should be set to be further smaller than that in each of normal fixing regions E2 and E3 which are present on an outside of the specific fixing region E1.

In this case, it is also possible to prevent a so-called raindrop-like picture quality failure from being caused in an execution of a fixation using a coating paper or an OHP sheet as the recording medium 9. In other words, it is also possible to prevent the raindrop-like picture quality failure from being caused, and at the same time, to prevent a crease from being generated in the execution of the fixation to the recording medium 9 such as the envelope and to prevent a defect such as a damage from being caused in the execution of the fixation using the envelope or the thick paper. The raindrop-like picture quality failure is caused due to a flow of a toner heated and molten in the pressure contact portion NP in a place (a valley) having a low pressure if the pressure contact portion NP includes the place having a low pressure between the head member 64 and the pad member 65 as illustrated in FIG. 18.

In the case in which the slant surface 67 is formed on the head member 64, the part having a low pressure is enlarged by the presence of the slant surface 67. For this reason, the raindrop-like picture quality failure is apt to be caused. In particular, the raindrop-like picture quality failure is apt to be caused in an end region in the rotating axis direction of the heating roll. By forming the slant surface 67 to be long in the central part of the specific fixing region E1 and to be relatively short at the ends, however, it is possible to suppress the raindrop-like picture quality failure which is apt to be caused at the ends.

Although there has been described the example of the structure in which the gap holding portion 66 is formed in the head member 64 in order to cause the clearance S to be present between the protruded portion 64*a* of the head member 64 and the pad member 65 in the embodiment, furthermore, the invention is not restricted to the case in which the means is employed. In addition, for example, it is also possible to employ a structure in which the pad member 65 is attached in a fixing state to a supporting plate 75 having a higher hardness than that of the pad member 65 and the whole supporting plate 75 is provided on an installing surface 64*b*-1 of a holding portion 64*b* in the head member 64 as shown in FIG. 16 or 17.

In this case, the pad member 65 is disposed in a fixing state to a position shifted inward from one end 75*a* of the supporting plate 75 by a distance G corresponding to the clearance S present between the pad member 65 and the protruded portion 64*a* of the head member 64. For the supporting plate 75, it is possible to use a hard plate formed by a synthetic resin or a metal plate. The supporting plate 75 does not need to take a shape of a flat plate if a gap holding function can be exhibited. With the structure, it is possible to dispose the head member 64 and the pad member 65 accurately and easily in a state in which the clearance S is present. Thus, it is also possible to reliably obtain an effect for preventing a crease of the specific recording medium 9A from being generated.

Figure 19:
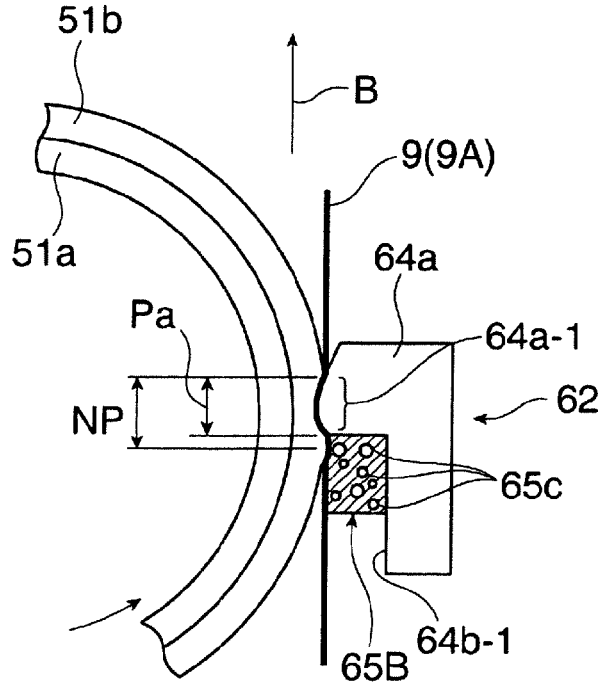
FIG. 19 is an explanatory view showing a further example of the structure of the pressurizing member (the pad member) in the fixing device and a state of a pressure contact portion thereof.

In the fixing device 4, moreover, it is also possible to use, as the pad member 65, a porous elastic member (for example, a sponge or a porous rubber) which is easily deformed elastically at a certain pressure and to dispose a porous pad member 65B on the head member 64 in a state in which the clearance S is present. However, the porous pad member 65B may be disposed on the head member 64 in a state in which the clearance S is not present as illustrated in FIG. 19. In FIG. 19, the reference numeral 65*c* denotes a void part to be a hole.

In this case, the pad member 65B constituted by the porous elastic member is freely deformed elastically without a particular restriction upon receipt of a reaction force of the elastic layer 51*b* of the heating roll 51 when the pressure contact portion NP is formed as a part of the pressurizing member 62. In the pressure contact portion NP, consequently, a force of the pad member 65B to push an endless belt 61 against the elastic layer 51*b* of the heating roll 51 is reduced and a force of the protruded portion 64*a* of the head member 64 to push the endless belt 61 and the elastic layer 51*b* is increased correspondingly. As a result, the deformation of the elastic layer 51*b* of the heating roll 51 in the pressure contact portion NP is relatively increased in a part pushed by the protruded portion 64*a* of the head member 64.

Accordingly, the elastic layer 51*b* of the heating roll 51 in a passage through the pressure contact portion NP takes an almost S-like curved shape as a whole by putting together an original cylindrical part formed in a relationship with a cylindrical roll base member 51*a* and a deformed part having an opposite curvature to the cylindrical shape formed by a push through the protruded portion 64*a* of the head member 64 in almost the same manner as in the case according to the embodiment. Also when the specific recording medium 9A such as the envelope passes through the pressure contact portion NP applying the pad member 65B, consequently, a difference in a moving speed on a surface and a back face can be reduced so that a crease can be prevented from being generated.

Moreover, it is also possible to employ a structure in which the clearance S is present by forming a gap holding portion in the pad member 65. Furthermore, it is also possible to employ a structure in which a concave portion (a shape of a dent) to be protruded toward the downstream side in the passing direction B in the rotating axis direction A is formed on a boundary wall surface portion 64*a*-3 of the protruded portion 64*a* in the head member 64 and a gap part of the concave portion is present as the clearance S.

In addition, the specific fixing region E1 can also be set to be the whole fixing set region E. For the specific recording medium 9A, it is also possible to apply recording media of types other than the envelope if the generation of the crease can be suppressed.

Furthermore, an imaging device for forming a monochrome toner image may be applied to the imaging device 2 in the image forming apparatus 1. The imaging device 2 does not need to employ a transferring method.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments are chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

a heating roll that includes an outer peripheral surface having an elastic layer formed thereon and is heated by a heating unit and is rotated;

an endless belt to be rotated in contact with an outer peripheral surface part in a rotating axis direction of the heating roll; and a pressurizing member that forms a pressure contact portion for pushing the endless belt against the outer peripheral surface part of the heating roll from an inner peripheral surface side of the pressurizing member so that a recording medium holding an unfixed image passes between the pressure contact portion and the heating roll, wherein the pressurizing member includes:

a hard pressurizing member disposed in a position on a downstream side in a passing direction of the recording medium in the pressure contact portion and having a higher hardness than that of the elastic layer of the heating roll; and a soft pressurizing member disposed in a position on an upstream side in the passing direction from the hard pressurizing member and having a lower hardness than that of the elastic layer of the heating roll to carry out an elastic deformation, and the hard pressurizing member and the soft pressurizing member are disposed in a state in which a clearance is present between the hard pressurizing member and the soft pressurizing member in a specific region part so that at least a specific recording medium passes in a fixing region of the pressure contact portion in the rotating axis direction of the heating roll.

2. The fixing device according to claim 1, wherein the soft pressurizing member is brought into a protruding state in such a direction as to approach the heating roll from the closest surface part of the hard pressurizing member to the heating roll when forming the pressure contact portion in the hard pressurizing member if the pressurizing member separates the endless belt from the heating roll and does not form the pressure contact portion.

3. The fixing device according to claim 2, wherein the soft pressurizing member is elastically deformed and compressed in such a direction as to separate from the heating roll as compared with a surface part of the hard pressurizing member when the pressurizing member pushes the endless belt against the heating roll to form the pressure contact portion.

4. The fixing device according to claim 1, wherein the soft pressurizing member takes such a shape as to gradually increase a dimension in the passing direction of the recording medium apart from the heating roll.

5. The fixing device according to claim 1, wherein the hard pressurizing member has a slant surface to approach the heating roll when a corner portion to be the upstream side in the passing direction of the recording medium is shifted toward the downstream side in the passing direction.

6. The fixing device according to claim 5, wherein the slant surface of the hard pressurizing member is formed in a state in which a length in the passing direction of the recording medium is greater in a central part in the rotating axis direction of the heating roll than an end thereof in the specific region part.

7. The fixing device according to claim 1, wherein the soft pressurizing member is disposed on a supporting member having a higher hardness than that of the soft pressurizing member in a fixing state to a position which is shifted inward by a distance corresponding to a clearance between the soft pressurizing member and the hard pressurizing member from an end thereof.

8. An image forming apparatus comprising:

an imaging device that forms an unfixed image and transfers the unfixed image onto a recording medium and a fixing device that fixes the unfixed image transferred by the imaging device to the recording medium, a fixing device according to claim 1 being used.

* * * * *